US012805689B2

(12) United States Patent
Kim et al.

(10) Patent No.: US 12,805,689 B2
(45) Date of Patent: Nov. 24, 2026

(54) STATION AND CLEANING SYSTEM INCLUDING THE SAME

(71) Applicant: Samsung Electronics Co., Ltd., Suwon-si (KR)

(72) Inventors: Sinae Kim, Suwon-si (KR); Kihwan Kwon, Suwon-si (KR); Youngho Ko, Suwon-si (KR); Kyoungwoung Kim, Suwon-si (KR); Seokki Song, Suwon-si (KR); Sewoong Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 297 days.

(21) Appl. No.: 18/639,174

(22) Filed: Apr. 18, 2024

(65) Prior Publication Data

US 2024/0407623 A1 Dec. 12, 2024

Related U.S. Application Data

(63) Continuation of application No. PCT/KR2024/003156, filed on Mar. 12, 2024.

(30) Foreign Application Priority Data

Jun. 8, 2023 (KR) ..... 10-2023-0073736

(51) Int. Cl.
*A47L 11/40* (2006.01)

(52) U.S. Cl.
CPC ..... *A47L 11/4091* (2013.01); *A47L 2201/028* (2013.01)

(58) Field of Classification Search
CPC ..... A47L 9/2873; A47L 11/4091; A47L 2201/028; A47L 2201/02
(Continued)

(56) References Cited

U.S. PATENT DOCUMENTS 11,690,493 B2 7/2023 Weis et al.
2020/0139561 A1 5/2020 Kim et al.
(Continued)

FOREIGN PATENT DOCUMENTS

CN 107951448 A 4/2018
CN 212118053 U 12/2020
(Continued)

OTHER PUBLICATIONS

Translation of WO2022253345A1 (Year: 2022).*
(Continued)

*Primary Examiner* — Tom Rodgers
(74) *Attorney, Agent, or Firm* — STAAS & HALSEY LLP

(57) ABSTRACT

Provided is a station configured to retrieve a used pad detached from a robot cleaner and supply a new pad to be attached to the robot cleaner, the station including a station body, a pad replacement unit provided at the station body to load the used pad detached from the robot cleaner, a pad storage having a received pad container configured to store the used pad and a pad supply container configured to store the new pad, and a pad transfer unit configured to sequentially press the used pad and the new pad, wherein the pad supply container is arranged above a movement path of the pad transfer unit, and the received pad container is arranged below the movement path of the pad transfer unit.

15 Claims, 28 Drawing Sheets

(58) Field of Classification Search
USPC ..... 15/3
See application file for complete search history.

(56) References Cited

U.S. PATENT DOCUMENTS

| | | | |
|---|---|---|---|
| 2022/0142444 | A1 | 5/2022 | Xie et al. |
| 2022/0211241 | A1 | 7/2022 | Zheng et al. |
| 2022/0287527 | A1 | 9/2022 | Hong et al. |
| 2022/0386834 | A1 | 12/2022 | Doughty et al. |
| 2022/0409001 | A1 | 12/2022 | Weis et al. |

FOREIGN PATENT DOCUMENTS

| | | | | |
|---|---|---|---|---|
| CN | 113966980 | A | 1/2022 | |
| CN | 114431781 | A | 5/2022 | |
| JP | 8-335112 | | 12/1996 | |
| KR | 10-2020-0052071 | | 5/2020 | |
| KR | 10-2021-0105908 | | 8/2021 | |
| KR | 10-2022-0004159 | | 1/2022 | |
| KR | 10-2022-0020360 | | 2/2022 | |
| WO | WO 2022/089434 | A1 | 5/2022 | |
| WO | WO-2022253345 | A1 * | 12/2022 | ..... A47L 11/28 |

OTHER PUBLICATIONS

International Search Report dated Jun. 26, 2024, in PCT/KR2024/003156.
European Search Report dated Apr. 21, 2026, in European Application No. EP 24 81 9451.

* cited by examiner

STATION AND CLEANING SYSTEM INCLUDING THE SAME

CROSS-REFERENCE TO RELATED APPLICATIONS

This application is a continuation of International Application PCT/KR2024/003156, filed Mar. 12, 2024, and claims foreign priority to Korean Application 10-2023-0073736, filed Jun. 8, 2023, which are incorporated herein by reference in their entireties.

TECHNICAL FIELD

The disclosure relates to a station and a cleaning system including the same, and more particularly, to a station for a cleaner to which a cleaning pad is attachable, and a cleaning system including the station.

BACKGROUND ART

A cleaner is a device for cleaning a target cleaning space by removing foreign substances such as dust from a floor, etc. In general, a robot cleaner that is a type of the cleaner may automatically perform a cleaning operation while moving in the target cleaning space, without user manipulation.

Recently, not only a robot cleaner having a function of sucking up foreign substances such as dust from a floor but also a robot cleaner having a function of wiping away dust from a floor are introduced. The robot cleaner that wipes away dust may have a cleaning pad for wiping away dust. However, the cleaning pad may become dirty during a cleaning process.

DISCLOSURE

Technical Solution

According to an embodiment of the disclosure, a station may be configured to retrieve a used pad detached from a robot cleaner and to supply a new pad to be attached to the robot cleaner.

According to an embodiment of the disclosure, a station for use with a robot cleaner may include a pad replacement unit, a pad storage including a received pad container and a pad supply container, and a pad transfer unit.

The pad replacement unit, the pad storage, and the pad transfer unit may be configured so that the pad transfer unit is movable in a first direction along a movement path from the pad replacement unit to the pad storage while pressing a used pad that was detached from the robot cleaner and loaded in the pad replacement unit, so that the used pad is moved by the pad transfer unit to the pad storage and received in the received pad container, and the pad transfer unit is movable in a second direction, opposite the first direction, along the movement path from the pad storage to the pad replacement unit while pressing a new pad that was stored in the pad supply container and supplied to the pad transfer unit, so that the new pad is moved by the pad transfer unit to the pad replacement unit to be attached to the robot cleaner.

The pad supply container may be above the movement path, and the received pad container may be below the movement path.

According to an embodiment of the disclosure, a cleaning system may include a robot cleaner, and a station. The station may include a pad replacement unit, a pad storage including a received pad container and a pad supply container, and a pad transfer unit, The pad replacement unit, the pad storage, and the pad transfer unit may be configured so that the pad transfer unit is movable in a first direction along a movement path from the pad replacement unit to the pad storage while pressing a used pad that was detached from the robot cleaner and loaded in the pad replacement unit, so that the used pad is moved by the pad transfer unit to the pad storage and received in the received pad container, and the pad transfer unit is movable in a second direction, opposite the first direction, along the movement path from the pad storage to the pad replacement unit while pressing a new pad that was stored in the pad supply container and supplied to the pad transfer unit, so that the new pad is moved by the pad transfer unit to the pad replacement unit to be attached to the robot cleaner.

The pad supply container may be above the movement path, and the received pad container may be below the movement path.

MODE FOR INVENTION

Figure 1:
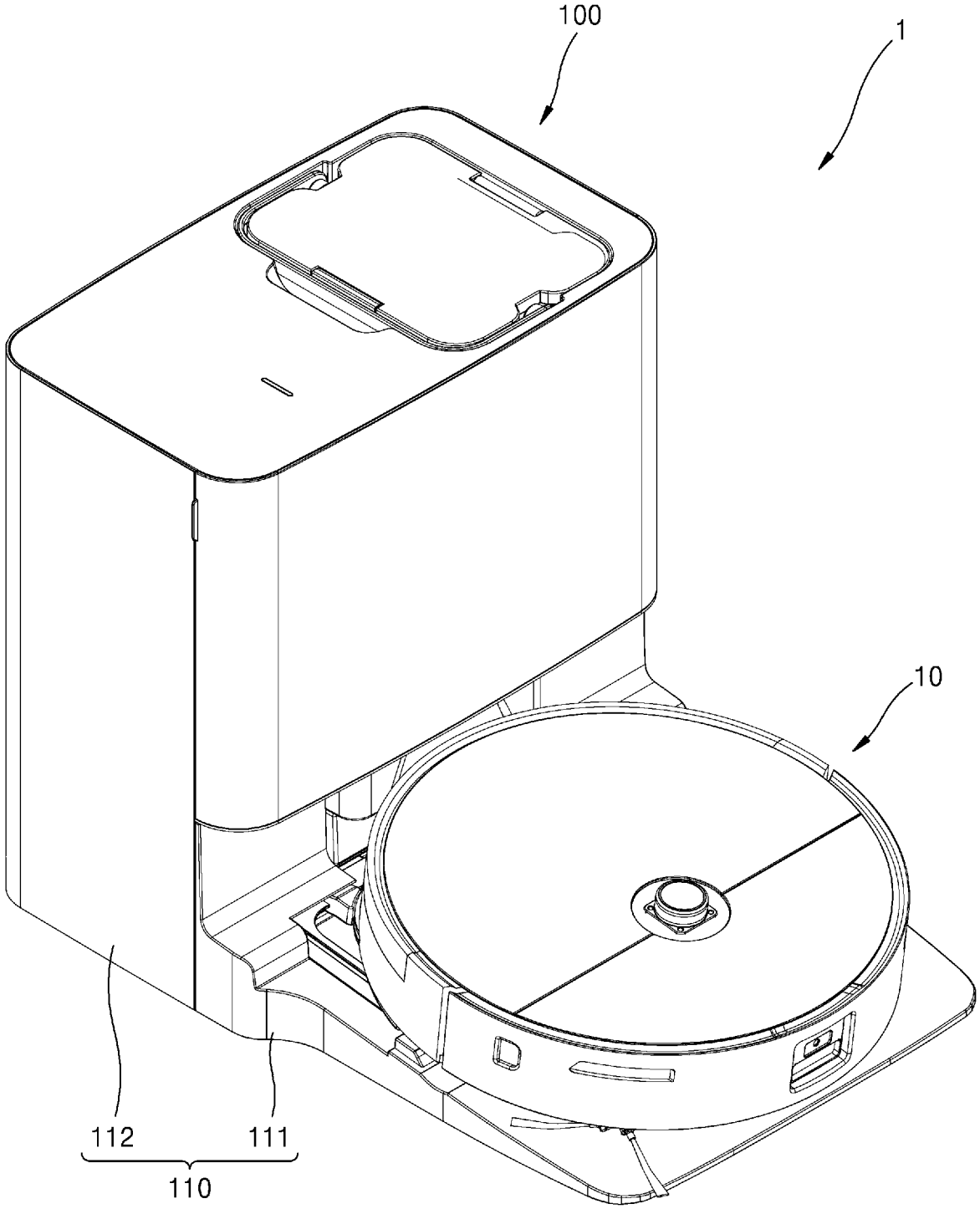
FIG. 1 is a perspective view illustrating a cleaning system according to an embodiment of the disclosure.

Hereinafter, embodiments of the disclosure will be described in detail with reference to the accompanying drawings. In the drawings, like reference numerals or signs denote parts or elements which perform substantially same functions.

It will be understood that, although the terms "first", "second", etc. may be used herein to describe various elements, these elements should not be limited by these terms. These terms are only used to distinguish one element from another element. For example, a first element discussed below could be termed a second element and, similarly, a second element could be termed a first element without departing from the scope of the disclosure. As used herein, the term "and/or" includes any and all combinations of one or more of the associated listed items.

The terms used in the present specification are merely used to describe embodiments of the disclosure, and are not intended to limit and/or restrict the disclosure. An expression used in the singular encompasses the expression of the plural, unless it has a clearly different meaning in the context. In the present specification, it is to be understood that the terms such as "including", "comprising" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added. In the drawings, like reference numerals denote elements which perform substantially same functions.

Figure 2:
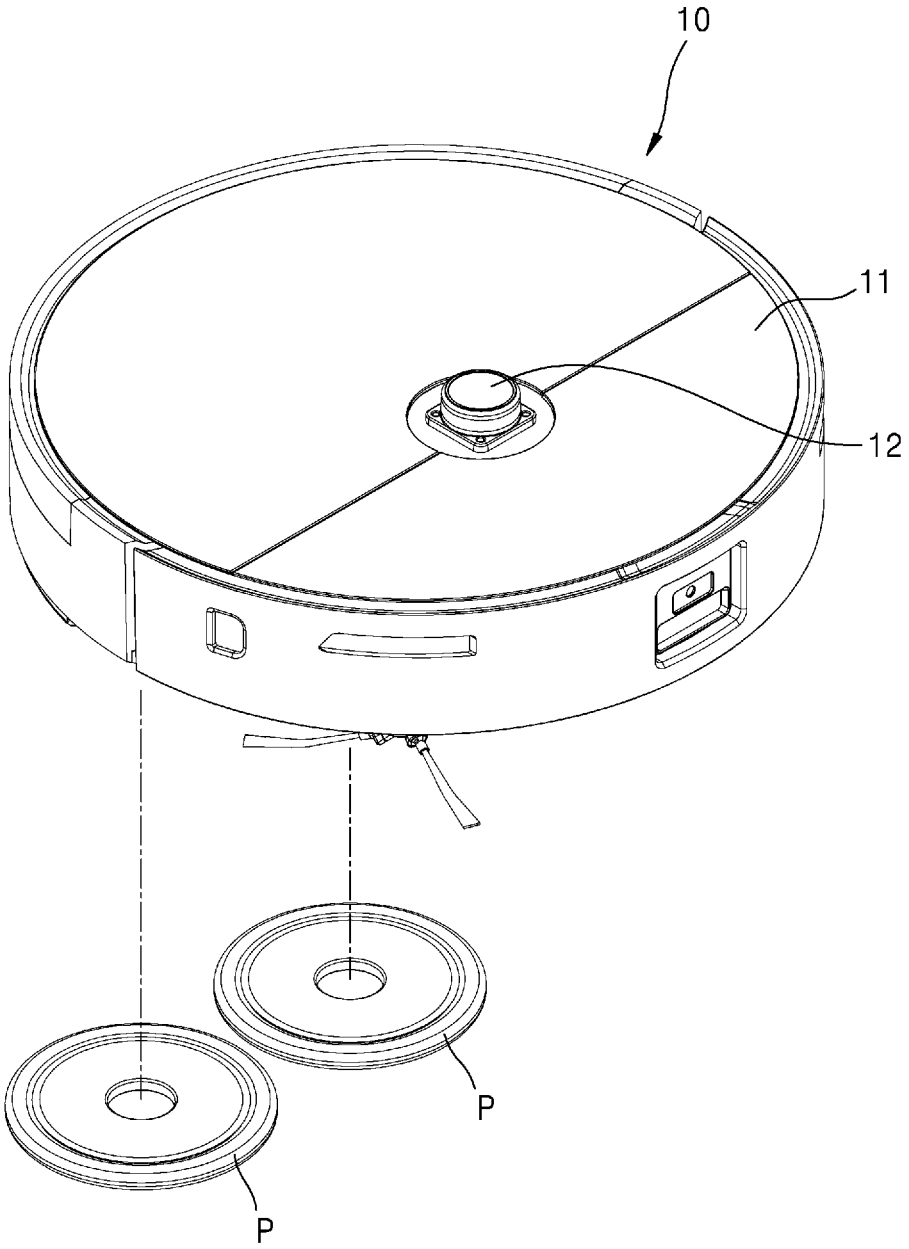
FIG. 2 is a diagram for describing an example of a robot cleaner of FIG. 1.

FIG. 1 is a perspective view illustrating a cleaning system 1 according to an embodiment of the disclosure, and FIG. 2 is a diagram for describing an example of a robot cleaner 10 of FIG. 1.

Referring to FIGS. 1 and 2, the cleaning system 1 according to an embodiment of the disclosure may include the robot cleaner 10 and a station 100 provided to replace a cleaning pad P of the robot cleaner 10.

The robot cleaner 10 may include the cleaning pad P. While the robot cleaner 10 moves, a floor surface may be cleaned by the cleaning pad P. For example, wet cleaning may be performed by the cleaning pad P. For example, dry cleaning may be performed by the cleaning pad P.

The cleaning pad P may have a disc-shape and may be provided in plural. For example, each of a pair of cleaning pads P may have a disc-shape. The disc-shape cleaning pad P may rotate to allow its bottom to repeatedly contact a floor surface. However, a shape of a cleaning pad P, the number of cleaning pads P, and an operation type of a cleaning pad P are not limited thereto, and thus, may vary. For example, one cleaning pad P may be provided, and a shape thereof may be rectangular. For example, the cleaning pad P may not rotate.

The robot cleaner 10 may be configured to automatically move. For example, the robot cleaner 10 may include a sensor 12 configured to detect an ambient environment and movement wheels for front and rear movement and rotation. By doing so, the robot cleaner 10 may automatically clean a target cleaning space while moving in the target cleaning space.

The cleaning pad P may be detachably attached to the robot cleaner 10. For example, the cleaning pad P may be detachably attached to a body 11 of the robot cleaner 10 by using a Velcro or Hook and Loop Fastener. For example, the cleaning pad P may be detachably attached to the body 11 of the robot cleaner 10 by using a magnetic field.

The robot cleaner 10 may include a configuration (not shown) for moving the cleaning pad P in up and down directions with respect to the body 11. By doing so, the cleaning pad P that is used may be detached from the body 11 of the robot cleaner 10 and an unused new cleaning pad P may be attached However, a configuration for detaching and attaching the cleaning pad P from and to the robot cleaner 10 is not limited thereto, and thus, may be variously configured.

The station 100 may be configured to retrieve a used pad that is the cleaning pad P detached from the robot cleaner 10 (hereinafter, the 'used pad P1'), and to supply a new pad that is the cleaning pad P to be attached to the robot cleaner 10 (hereinafter, the 'new pad P2'). In other expression, the station 100 may be configured to replace the cleaning pad P.

The station 100 includes a station body 110, and a pad replacement unit 120 provided at the station body 110 for the robot cleaner 10 to replace the cleaning pad P. The pad replacement unit 120 will be described below based on FIG. 3 and drawings thereafter.

The station 100 may perform functions in addition to a replacement function of the cleaning pad P. For example, when the robot cleaner 10 has a battery, the station 100 may perform a function of charging the battery of the robot cleaner 10. For example, in a case where the robot cleaner 10 has a dust cabin for storing dusts, the station 100 may perform a function of emptying the dust cabin of the robot cleaner 10. For example, in a case where the robot cleaner 10 has a water container for water cleaning, the station 100 may perform a function of supplying water to the water container of the robot cleaner 10.

Figure 3:
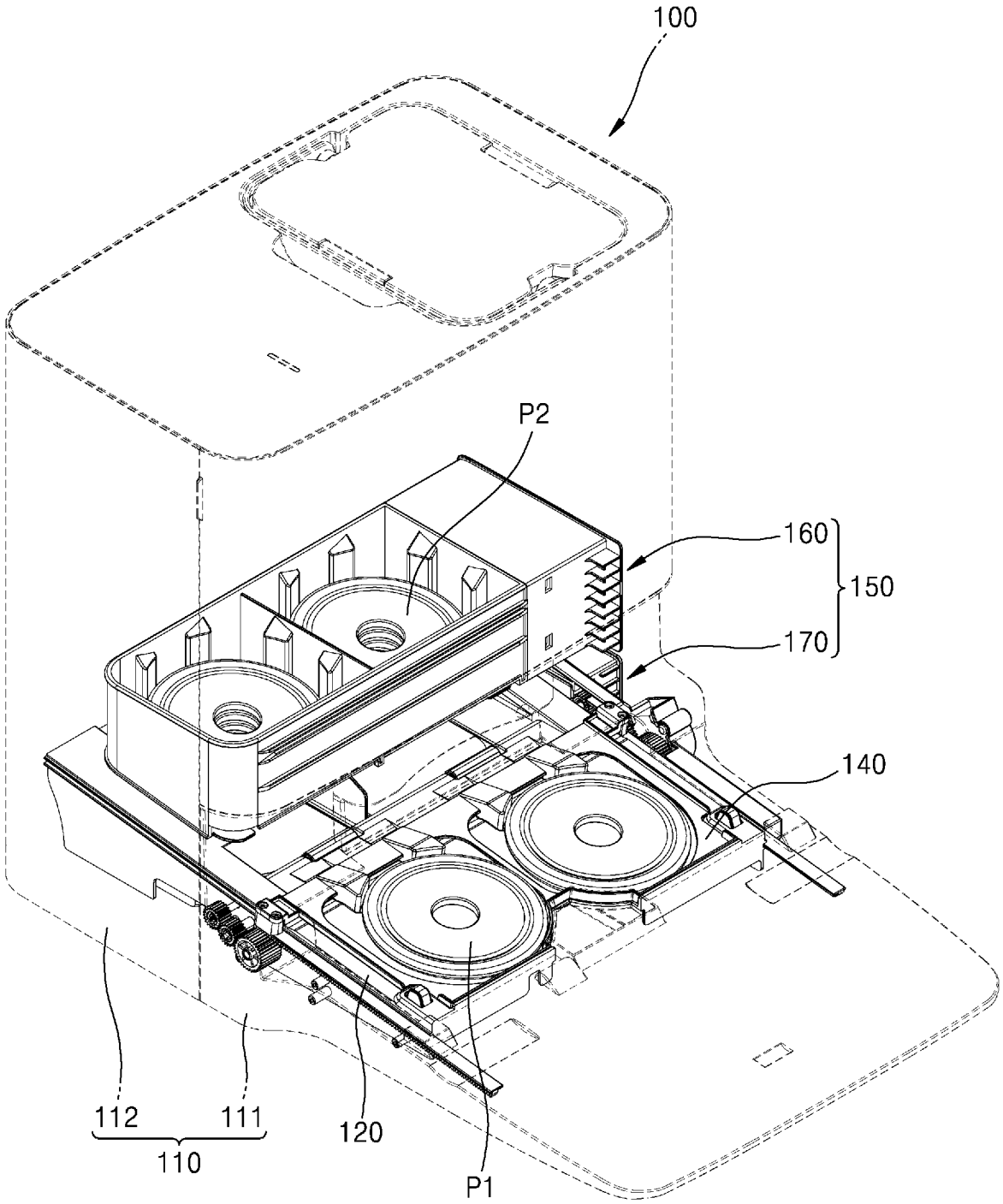
FIG. 3 is a perspective view illustrating an inner configuration of a station according to an embodiment of the disclosure.
Figure 4:
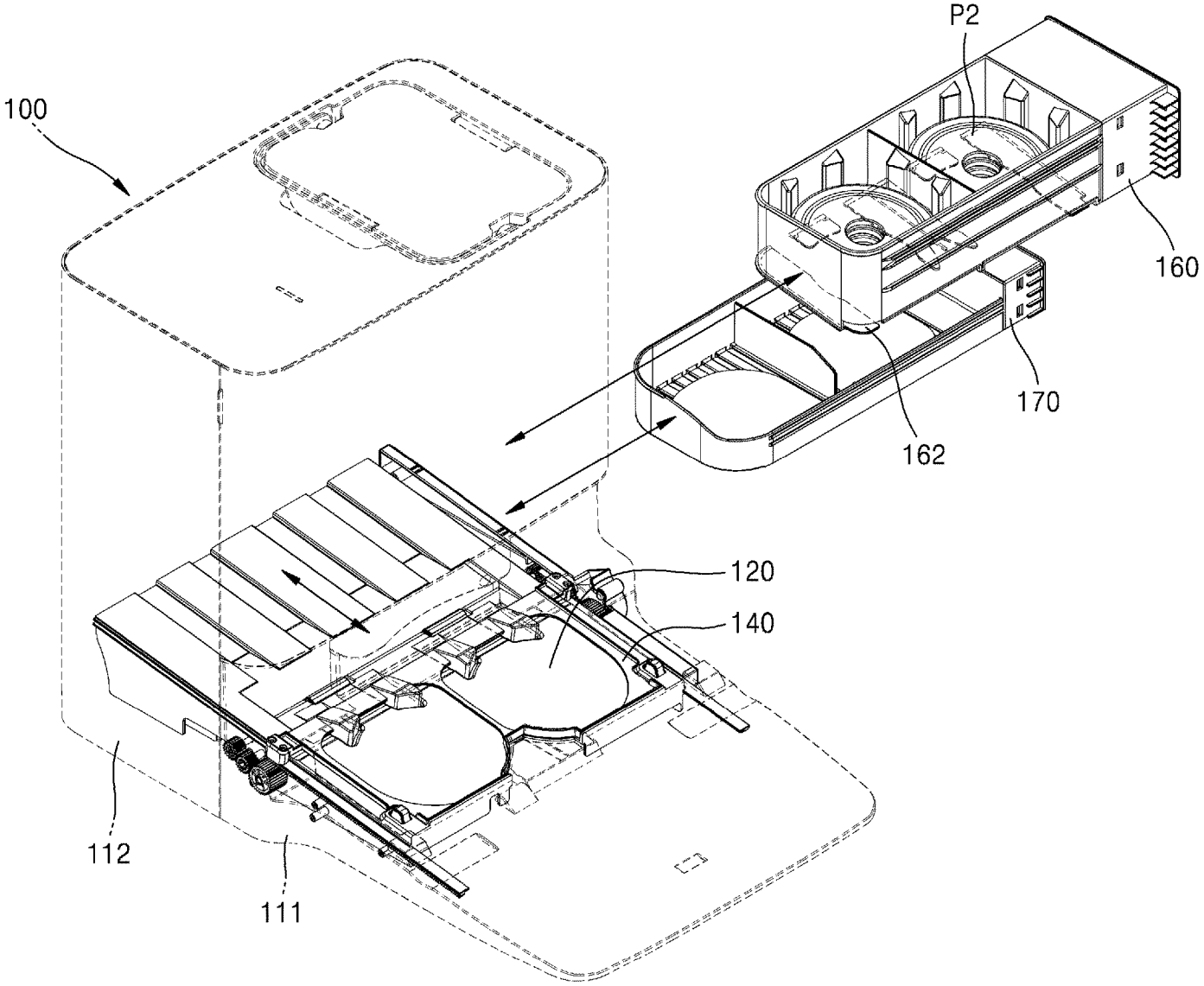
FIG. 4 is a perspective view illustrating a state in which a pad storage is detached from the station of FIG. 3.
Figure 5:
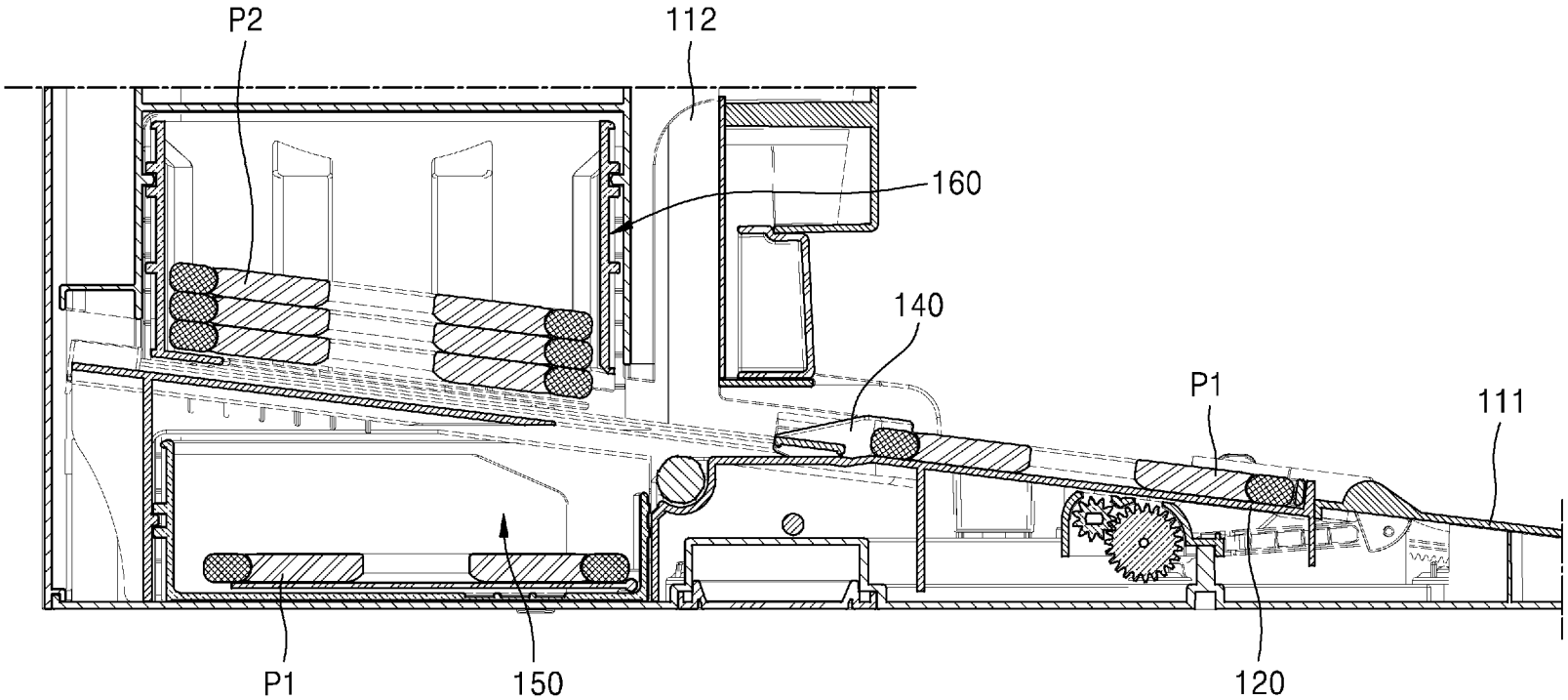
FIG. 5 is a cross-sectional view of the station of FIG. 3, which is partially cut.

FIG. 3 is a perspective view illustrating an inner configuration of the station 100 according to an embodiment of the disclosure, and FIG. 4 is a perspective view illustrating a state in which a pad storage 150 is detached from the station 100 of FIG. 3. FIG. 5 is a cross-sectional view of the station 100 of FIG. 3 which is partially cut.

Referring to FIGS. 3 to 5, the station 100 according to an embodiment of the disclosure may include the station body 110, the pad replacement unit 120, the pad storage 150, and a pad transfer unit 140.

The station body 110 may include a station base 111, and a station tower 112 provided in the rear side of the station base 111.

The station base 111 may provide a space in which the robot cleaner 10 may be located. The robot cleaner 10 may move upward above the station base 111 when there is a need to replace the cleaning pad P. The station base 111 may have a slant surface for easy entry and exit of the robot cleaner 10.

The station tower 112 may have a preset height and may internally contain the pad storage 150. The height of the station tower 112 may be greater than a height of the station base 111.

The pad replacement unit 120 may be provided at the station body 110. The pad replacement unit 120 may be provided at the station body 110 so as to load the used pad P1 detached from the robot cleaner 10. The pad replacement unit 120 may be provided at the station body 110 so as to be exposed through an upper portion of the station base 111. The pad replacement unit 120 may be provided at the station body 110 so as to overlap the robot cleaner 10 in up and down directions. For example, the pad replacement unit 120 may be arranged at the station base 111. Accordingly, as shown in FIG. 1, when the robot cleaner 10 is located at the station body 110, the pad replacement unit 120 may be located while overlapping the used pad P1 of the robot cleaner 10 in up and down directions. For example, the pad replacement unit 120 may be located below the used pad P1 of the robot cleaner 10.

The used pad P1 detached from the robot cleaner 10 may be placed at the pad replacement unit 120. Before the used pad P1 is detached from the robot cleaner 10, the pad replacement unit 120 may have an empty state in which the used pad P1 is not placed.

The new pad P2 to be coupled to the robot cleaner 10 may be placed at the pad replacement unit 120 at a different timing from the used pad P1. For example, the new pad P2 may be placed at the pad replacement unit 120 after the used pad P1 is retrieved. The used pad P1 and the new pad P2 may be sequentially placed at the pad replacement unit 120.

The pad storage 150 may be arranged in the station tower 112. The pad storage 150 may be configured to store the cleaning pad P. For example, the pad storage 150 may include a pad supply container 160 configured to store the new pad P2, and a received pad container 170 configured to store the used pad P1. The pad storage 150 may be arranged in the station body 110. The pad supply container 160 and the received pad container 170 may be arranged in the station tower 112.

The pad supply container 160 may be arranged in the station body 110 so as to be apart from the pad replacement unit 120. For example, the pad supply container 160 may be arranged in the station tower 112 so as to be apart from the pad replacement unit 120. The new pad P2 to be provided at the pad replacement unit 120 may be stored in the pad supply container 160. A plurality of the new pads P2 may be vertically stacked and stored in the pad supply container 160.

The pad supply container 160 may be assembled to be detachable from the station tower 112. For example, the pad supply container 160 may be assembled to be detachable from the station tower 112 in a direction perpendicular to the stack direction of the new pad P2.

The pad supply container 160 includes a pair of pad support units 162 to support a bottom of the new pad P2. The pair of pad support units 162 may support both bottom ends of the new pad P2. A plurality of the new pads P2 may be loaded on the pad support unit 162.

The pair of pad support units 162 may be apart from each other in a direction perpendicular to a movement direction of the pad transfer unit 140. The pad transfer unit 140 may move in a gap between the pair of pad support units 162 that are apart from each other.

The received pad container 170 may be provided at the station body 110 so as to be apart from the pad replacement unit 120. For example, the pad supply container 160 may be provided in the station tower 112 arranged to be apart from the pad replacement unit 120. The used pad P1 that was provided to the pad replacement unit 120 may be stored in the received pad container 170. The received pad container 170 may be arranged in the station tower 112.

The received pad container 170 may be assembled to be detachable from the station tower 112. For example, the received pad container 170 may be assembled to be horizontally detachable from the station tower 112. For example, the received pad container 170 may be assembled to be detachable from the station tower 112 in a direction parallel to the pad supply container 160.

The received pad container 170 may be arranged below the pad supply container 160. In other expression, the pad supply container 160 may be arranged above the received pad container 170. For example, the pad supply container 160 and the received pad container 170 may be vertically aligned or arranged in the station body 110. At least a portion of the pad supply container 160 and the received pad container 170 may be arranged to overlap in a vertical direction at the station body 110. For example, the pad supply container 160 and the received pad container 170 may be vertically arranged on the station tower 112 of the station body 110. As the received pad container 170 and the pad supply container 160 are vertically arranged, an area of the station 100 which is occupied by the pad storage 150 may be decreased.

Although not illustrated, a dust collecting box for receiving dust of the robot cleaner 10, a water tank for storing water to be supplied to the robot cleaner 10, or the like may be arranged in the station tower 112. The pad storage 150 may be arranged in a vertical direction to the dust collecting box or the water tank. By doing so, an area of the pad storage 150 which is occupied in the station 100 may be further decreased.

Figure 6:
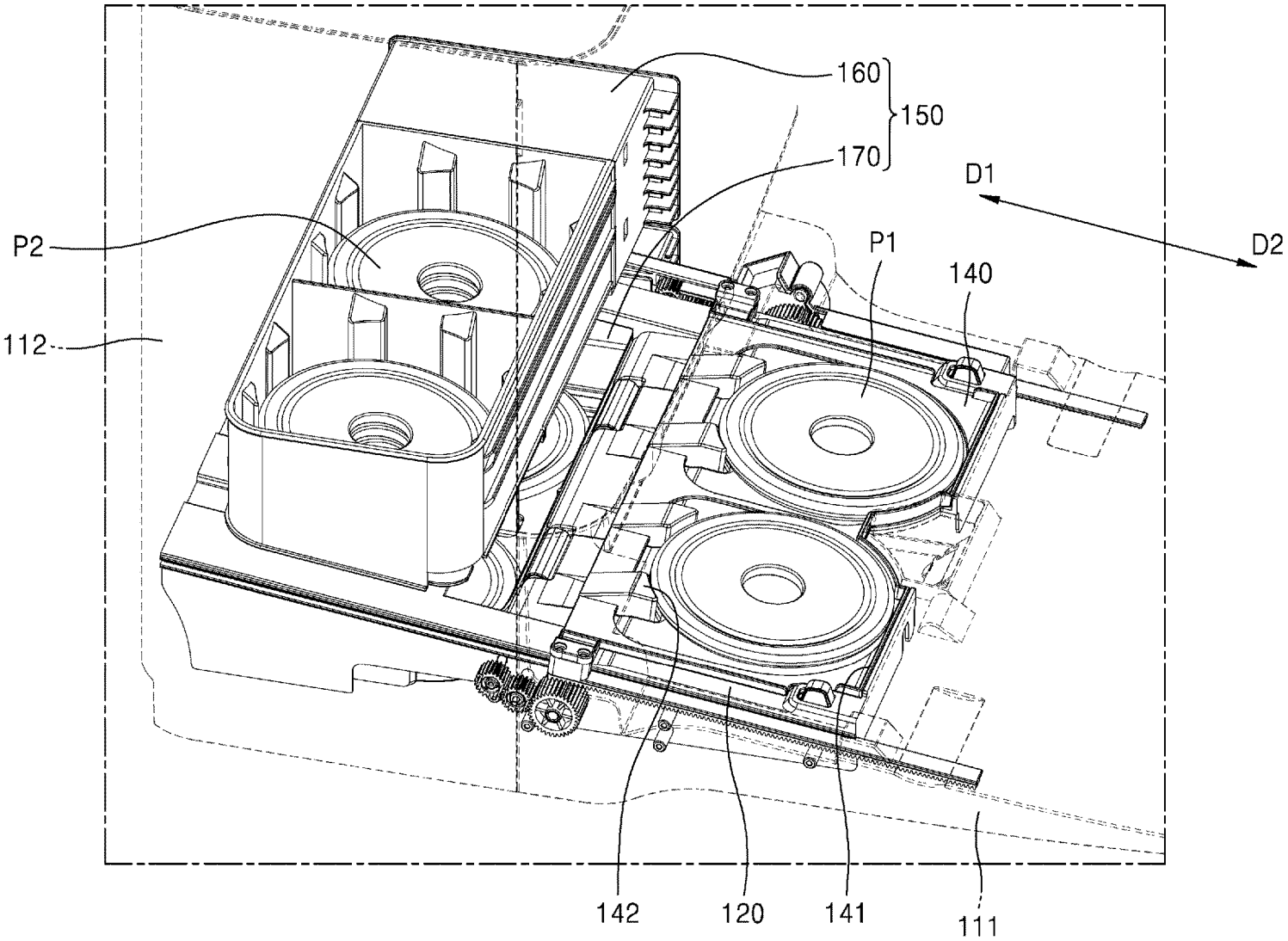
FIG. 6 is a perspective view for describing a configuration for transferring a cleaning pad in the station according to an embodiment of the disclosure.
Figure 7:
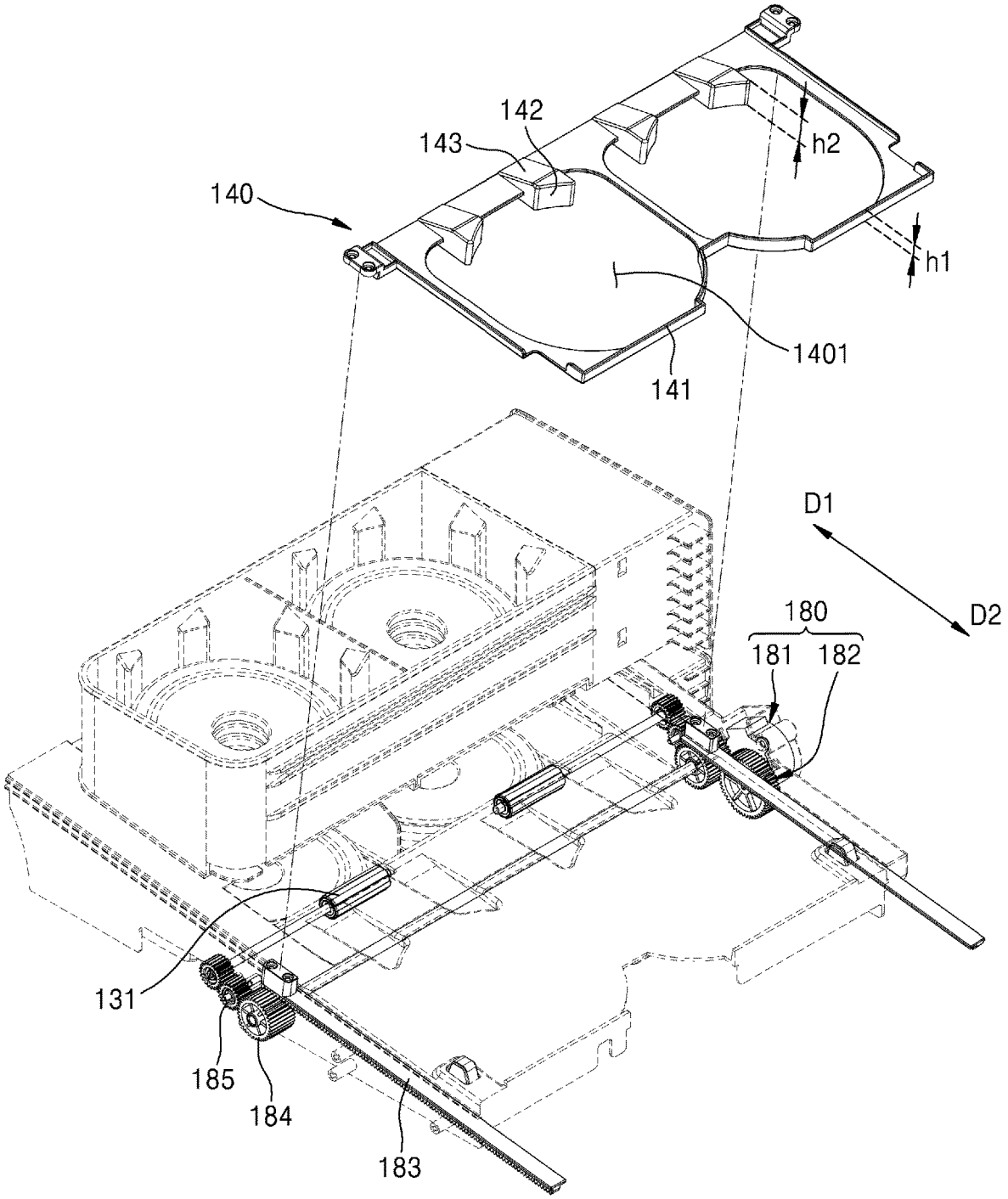
FIG. 7 is a perspective view illustrating a state in which a pad transfer unit is detached from the station of FIG. 6.

FIG. 6 is a perspective view for describing a configuration for transferring the cleaning pad P in the station 100 according to an embodiment of the disclosure, and FIG. 7 is a perspective view illustrating a state in which the pad transfer unit 140 is detached from the station 100 of FIG. 6.

Referring to FIGS. 6 and 7, the pad transfer unit 140 may be configured to press the used pad P1 or the new pad P2. For example, the pad transfer unit 140 may be configured to sequentially press the used pad P1 and the new pad P2. For example, the pad transfer unit 140 may be provided at the station body 110 so as to reciprocate between the pad replacement unit 120 and the pad storage 150. While the pad transfer unit 140 reciprocates, the pad transfer unit 140 may sequentially press the used pad P1 and the new pad P2. The pad transfer unit 140 may be configured to press the used pad P1 and then to press the new pad P2. For example, the pad transfer unit 140 may be configured to press the used pad P1 and then to press the new pad P2 by switching a movement direction. For example, the pad transfer unit 140 may be configured to move in a first direction so as to press the used pad P1 and then to move in a second direction so as to press the new pad P2.

For example, the pad transfer unit 140 may include a pad hole 1401 into which the cleaning pad P can be inserted, and a first pressure area 141 and a second pressure area 142 which are arranged by having the pad hole 1401 therebetween. The pad transfer unit 140 may be implemented as one body, but the disclosure is not limited thereto, and a plurality of bodies may be assembled to be implemented.

The used pad P1 or the new pad P2 may be inserted into the pad hole 1401. A size of the pad hole 1401 may correspond to or be larger than a size of the used pad P1 or the new pad P2.

When the pad transfer unit 140 moves toward the pad storage 150, the first pressure area 141 may press an end part of the used pad P1 to orientate the used pad P1 to face the received pad container 170. For example, when the pad transfer unit 140 moves toward the pad supply container 160, the first pressure area 141 may press the end part of the used pad P1.

When the pad transfer unit 140 moves toward the pad replacement unit 120, the second pressure area 142 may press an end part of the new pad P2 to orientate the new pad P2 to face the pad replacement unit 120. For example, when the pad transfer unit 140 moves toward the pad replacement unit 120, the second pressure area 142 may press the end part of the new pad P2.

A shape of the second pressure area 142 may be different from a shape of the first pressure area 141. For example, a height h2 of the second pressure area 142 may be greater than a height h1 of the first pressure area 141.

The height h2 of the second pressure area 142 may be greater than a thickness of the new pad P2. For example, the height h2 of the second pressure area 142 may be about 1.5 times to about 2.5 times as great as the thickness of the new pad P2. As the height h2 of the second pressure area 142 is designed to be greater than the thickness of the new pad P2, the second pressure area 142 can surely press the new pad P2 when the pad transfer unit 140 moves.

The pad transfer unit 140 may further include an uplift-downlift induce area 143 that induces uplift and downlift of the new pad P2. In a procedure where the pad transfer unit 140 moves toward the pad storage 150 and then is inserted into the pad supply container 160, the uplift-downlift induce area 143 may induce uplift and downlift of the new pad P2 stored in the pad supply container 160. When the pad transfer unit 140 moves toward the pad supply container 160, the uplift-downlift induce area 143 may induce uplift and downlift of the new pad P2 while contacting the new pad P2. For example, a height of the uplift-downlift induce area 143 may be decreased along a movement direction, e.g., a first direction D1, of the pad transfer unit 140. In another expression, the uplift-downlift induce area 143 may have a slant surface of which height increases in a second direction D2. The uplift-downlift induce area 143 may be provided upstream of the second pressure area 142 in the second direction D2 of the pad transfer unit 140. In another expression, the uplift-downlift induce area 143 may be provided in the front end in the first direction D1 of the pad transfer unit 140.

Figure 8:
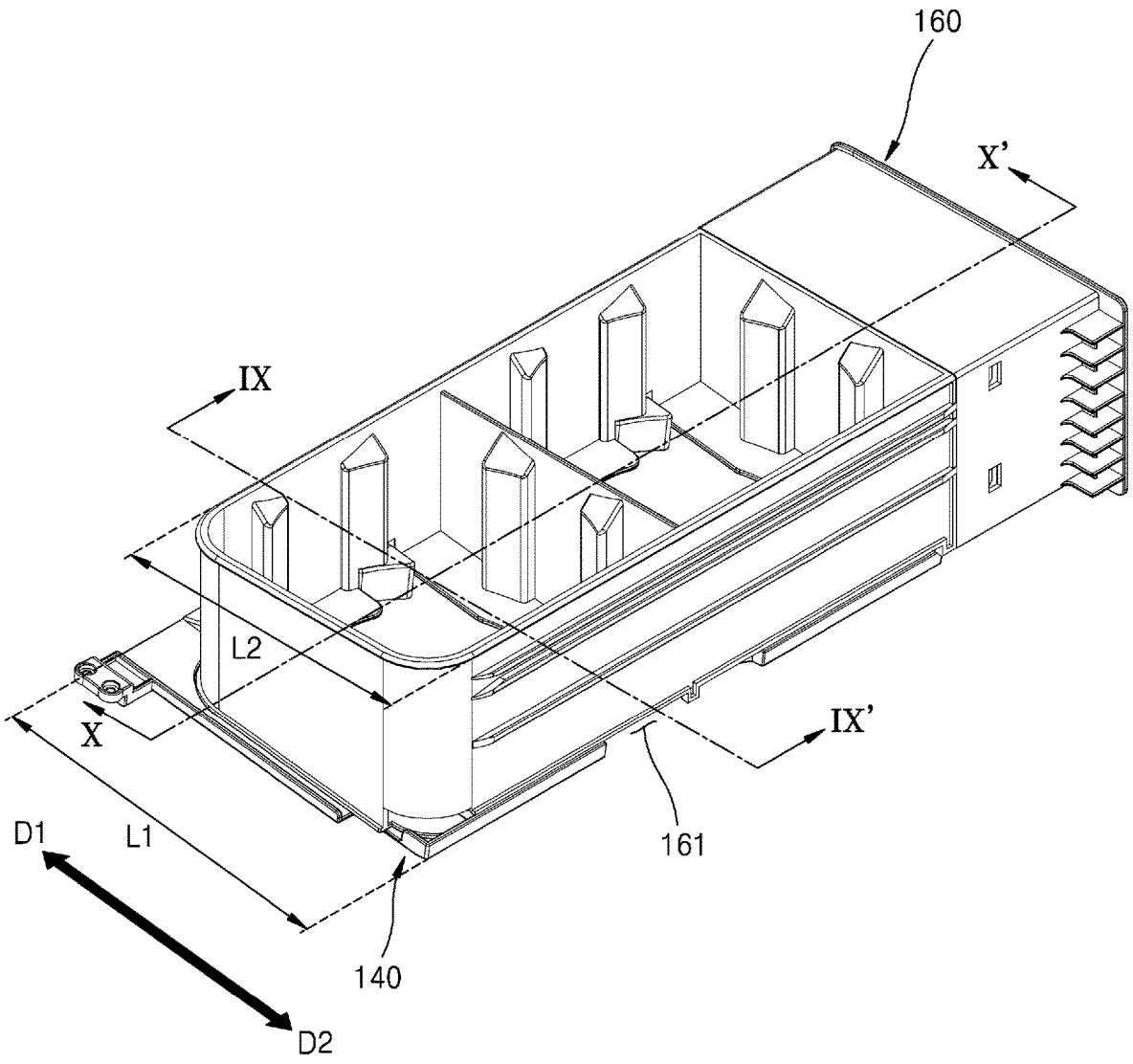
FIG. 8 is a perspective view illustrating a state in which a pad transfer unit is located at a pad supply container in the station according to an embodiment of the disclosure.
Figure 9:
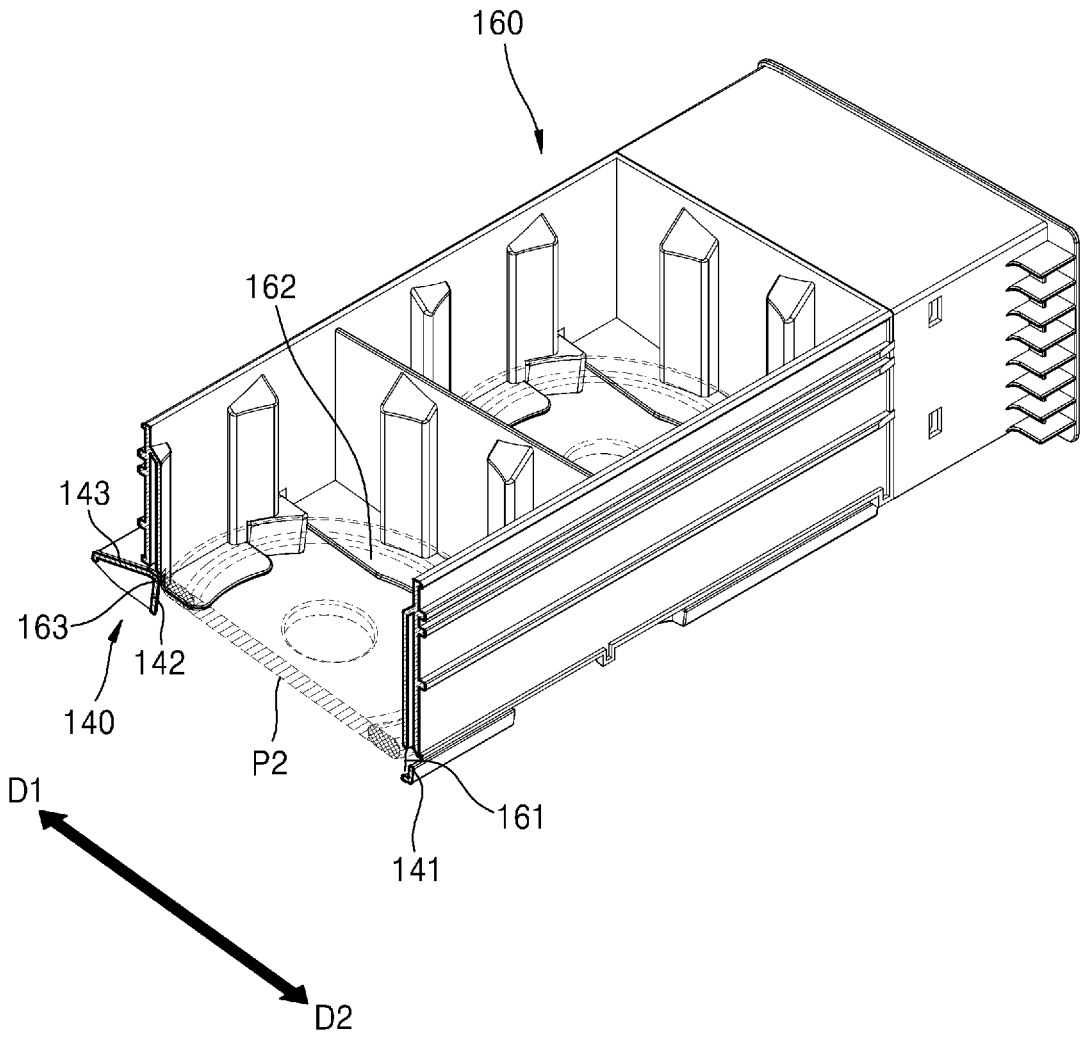
FIG. 9 is a cross-sectional view of the pad transfer unit and the pad supply container of FIG. 8.

FIG. 8 is a perspective view illustrating a state in which the pad transfer unit 140 is located at the pad supply container 160 in the station 100 according to an embodiment of the disclosure. FIG. 9 is a cross-sectional view of the pad transfer unit 140 and the pad supply container 160 of FIG. 8, and FIG. 10 is a cross-sectional view of the pad transfer unit 140 and the pad supply container 160 of FIG. 8.

Referring to FIGS. 8 and 9, in a procedure where the pad transfer unit 140 moves toward the pad supply container 160, the uplift-downlift induce area 143 may pass the new pad P2 in the first direction D1. While the uplift-downlift induce area 143 passes the new pad P2 in the first direction D1, the new pad P2 may be lifted upward due to the uplift-downlift induce area 143, and after the uplift-downlift induce area 143 passes, the new pad P2 may be lifted downward due to its gravity. The down-lifted new pad P2 is arranged to face the second pressure area 142. The new pad P2 is arranged between the first pressure area 141 and the second pressure area 142 of the pad transfer unit 140 while the new pad P2 is supported by the pad support unit 162 of the pad supply container 160.

The pad supply container 160 may include a pad outlet 161 capable of discharging only the new pad P2 at the bottom from among a plurality of new pads P2. For example, a top end of the pad outlet 161 is higher than a top surface of the new pad P2 at the bottom and is lower than a top surface of the new pad P2 at the second-lowest bottom. A height of the pad outlet 161 may be equal to or greater than 1 times as great as a thickness of the new pad P2 and may be less than 2 times as great as the thickness. The height of the pad outlet 161 may be defined to be a height from the pad support unit 162.

Figure 10:
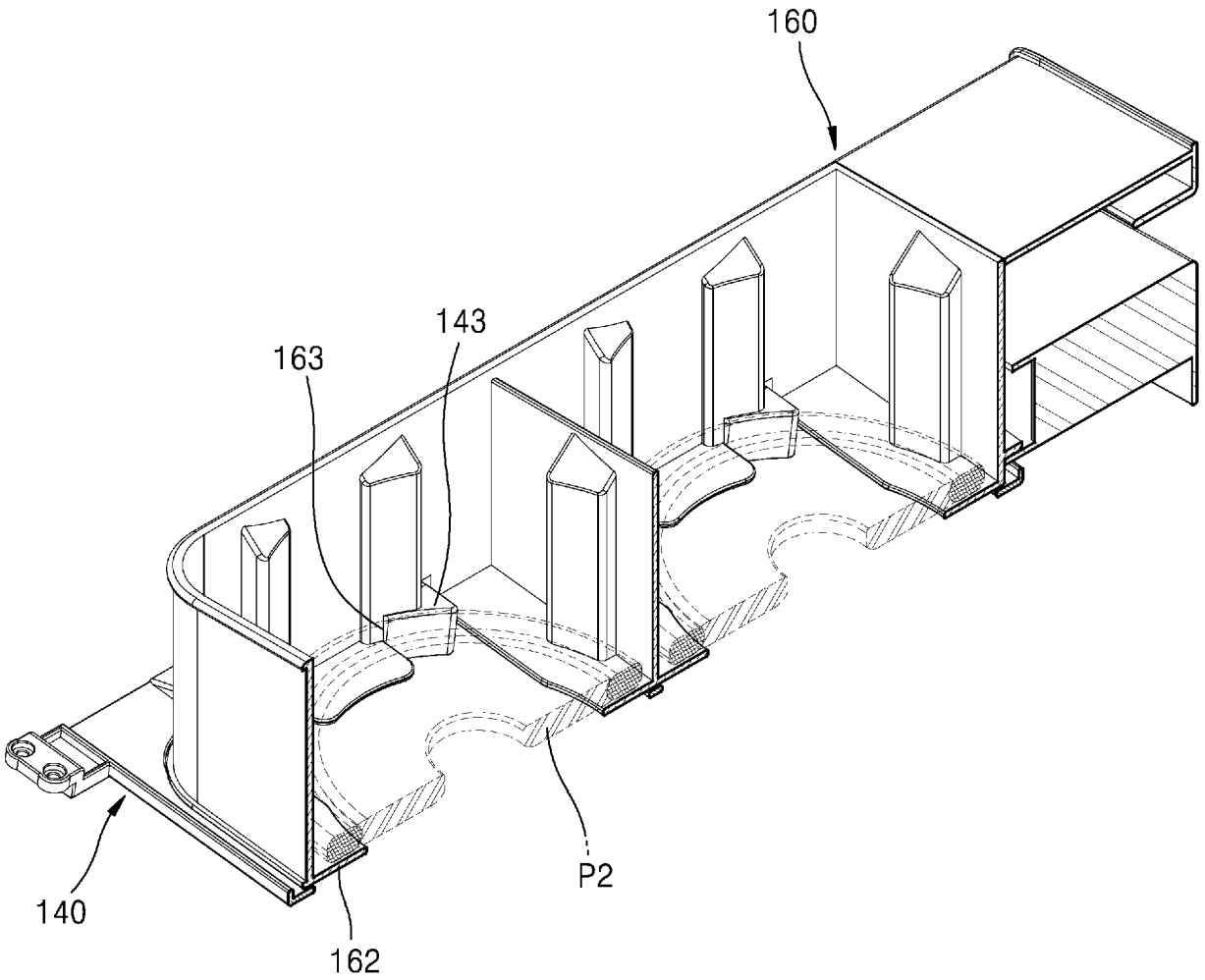
FIG. 10 is a cross-sectional view of the pad transfer unit and the pad supply container of FIG. 8.

Referring to FIGS. 8 and 10, the pad supply container 160 may further include a cut part 163 through which at least a part of the uplift-downlift induce area 143 can pass. When the pad transfer unit 140 moves toward the pad supply container 160, the uplift-downlift induce area 143 of the pad transfer unit 140 may pass through the cut part 163 of the pad supply container 160, and by doing so, a length L2 of the pad supply container 160 may be designed to be shorter than a length L1 of the pad transfer unit 140. Here, a length may be defined as a length according to a movement direction of the pad transfer unit 140.

The pad transfer unit 140 may reciprocate between the pad replacement unit 120 and the pad supply container 160. The pad transfer unit 140 may reciprocate between the pad replacement unit 120 and the pad support unit 162 of the pad supply container 160. The pad transfer unit 140 may move along a first direction D1 from the pad replacement unit 120 to the pad supply container 160 and a second direction D2 from the pad supply container 160 to the pad replacement unit 120. The second direction D2 may be different from the first direction D1. The second direction D2 and the first direction D1 may be opposite to each other.

The first direction D1 may have a preset slope with respect to the ground. An angle of the first direction D1 with respect to the ground may correspond to an angle of the slant surface of the station base 111. In another expression, a movement path PH (see FIG. 11) of the pad transfer unit 140 may have a preset slope with respect to the ground. However, the first direction D1 is not limited to have the slope with respect to the ground, and may be parallel to the ground.

Referring back to FIGS. 6 and 7, the station 100 may further include a driving unit 180 for reciprocating movement of the pad transfer unit 140. For example, the driving unit 180 may include a driving motor 181, and a power transfer unit 182 configured to transfer power of the driving motor 181 to the pad transfer unit 140.

The driving motor 181 may provide driving power to the power transfer unit 182. For example, the driving motor 181 may be a step motor. However, a type of the driving motor 181 is not limited thereto, and thus, may vary.

The power transfer unit 182 may be installed in the station body 110. The power transfer unit 182 may include a rack gear 183 and a pinion gear 184 that engages with the rack gear 183. The rack gear 183 may extend along a movement direction of the pad transfer unit 140. The rack gear 183 may slide in a direction parallel to the first direction D1 and the second direction D2.

The pad transfer unit 140 may be fixed to the power transfer unit 182. For example, the pad transfer unit 140 may be fixed to the rack gear 183. As the pinion gear 184 rotates, the rack gear 183 and the pad transfer unit 140 fixed to the rack gear 183 may move along the first direction D1 or the second direction D2.

The rotation of the pinion gear 184 may be determined by a rotation direction of the driving motor 181. When the rotation direction of the driving motor 181 changes, a rotation direction of the pinion gear 184 connected to the driving motor 181 may change. When the rotation direction of the pinion gear 184 changes, a movement direction of the pad transfer unit 140 may change.

Due to the driving unit 180, the pad transfer unit 140 may reciprocate along the first direction D1 and the second direction D2.

While the pad transfer unit 140 reciprocates along the first direction D1 and the second direction D2, the used pad P1 may be transferred from the pad replacement unit 120 to the received pad container 170, and the new pad P2 may be transferred from the pad supply container 160 to the pad replacement unit 120.

For example, in a case where the used pad P1 is detached from the robot cleaner 10 and then is inserted into the pad hole 1401 of the pad transfer unit 140, the pad transfer unit 140 may move from the pad replacement unit 120 to the pad supply container 160. While the pad transfer unit 140 moves, the first pressure area 141 may press the used pad P1. For example, in a case where the new pad P2 is inserted into the pad hole 1401 of the pad transfer unit 140, the pad transfer unit 140 may move from the pad supply container 160 to the pad replacement unit 120. While the pad transfer unit 140 moves, the second pressure area 142 may press the new pad P2.

Figure 11:
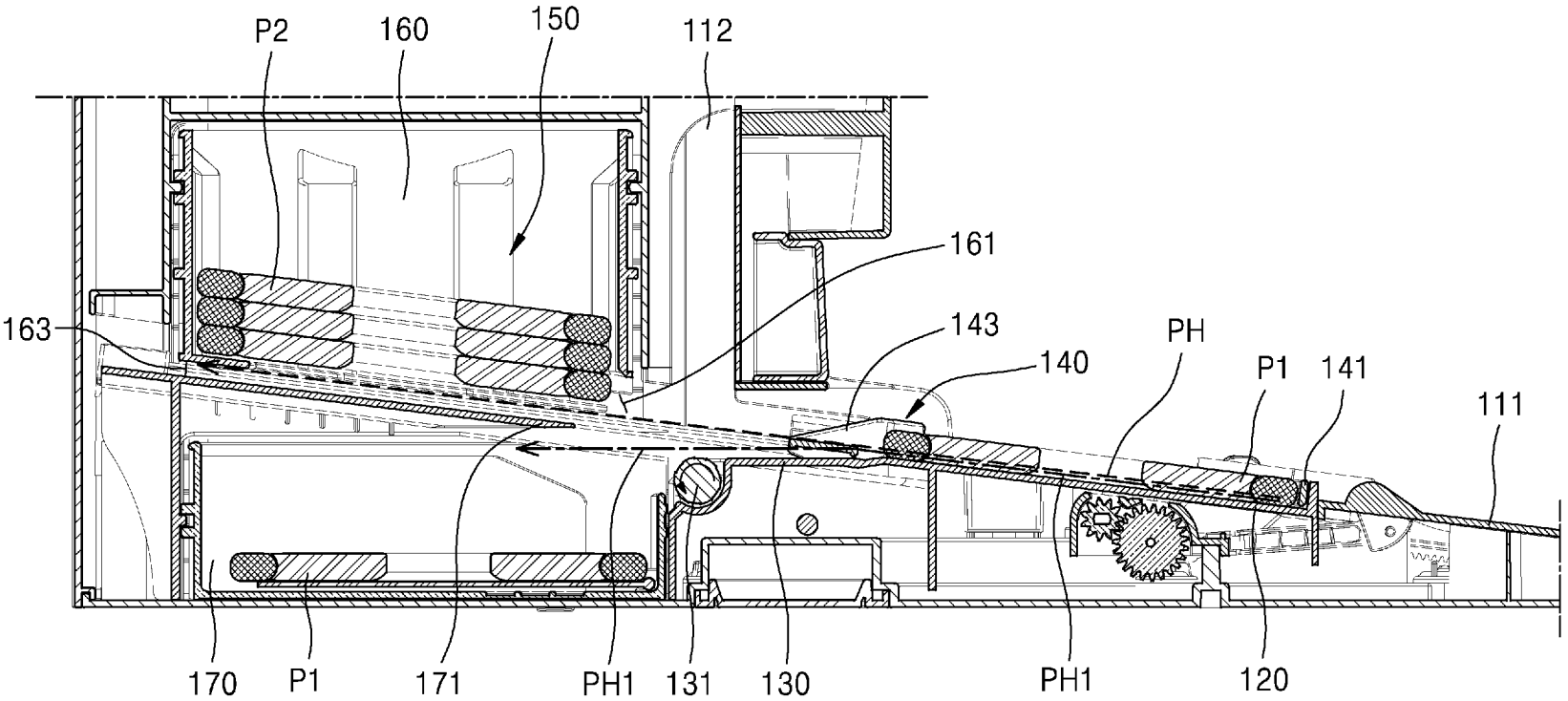
FIG. 11 is a diagram for describing movement of a pad transfer unit which causes movements of a used pad and a new pad in the station of FIG. 6.
Figure 12:
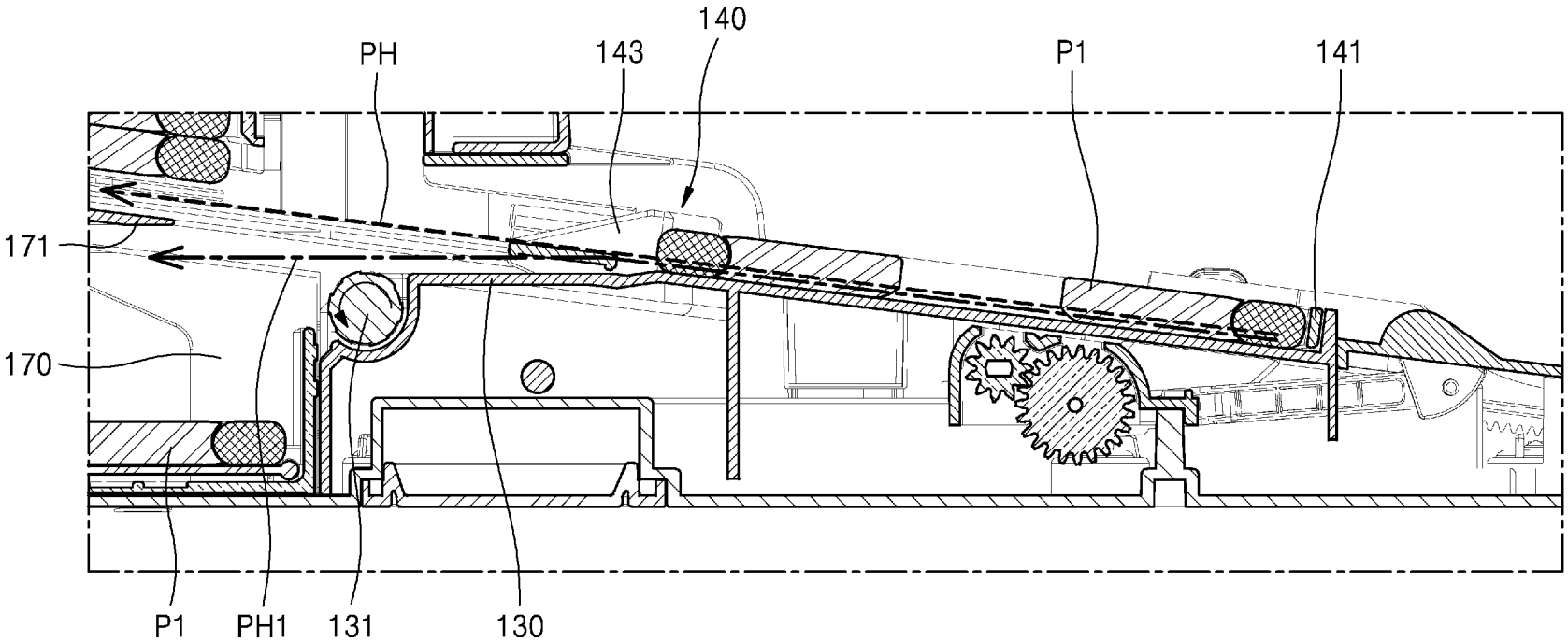
FIG. 12 is a magnified view of a part of the station of FIG. 11.

FIG. 11 is a diagram for describing movement of the pad transfer unit 140 which causes movements of the used pad P1 and the new pad P2 in the station 100 of FIG. 6. FIG. 12 is a magnified view of a part of the station 100 of FIG. 11.

Referring to FIGS. 11 and 12, the received pad container 170 and the pad supply container 160 may be arranged in a direction crossing a movement direction of the pad transfer unit 140. The pad supply container 160 is arranged above a movement path PH of the pad transfer unit 140, and the received pad container 170 may be arranged below the movement path PH of the pad transfer unit 140. For example, the pad supply container 160 and the received pad container 170 may be arranged in up and down directions For example, the pad supply container 160 and the received pad container 170 may be arranged in up and down directions in the station tower 112. However, the arrangement of the pad supply container 160 and the received pad container 170 is not limited thereto, and thus, may vary. For example, although not illustrated, the pad supply container 160 may be arranged above the movement path PH of the pad transfer unit 140 in the station tower 112, and the received pad container 170 may be arranged below the movement path PH of the pad transfer unit 140 in the station base 111.

The station 100 may further include a pad guide unit 130 to make the used pad P1 move to the received pad container 170 arranged below the pad supply container 160. The pad guide unit 130 may be configured in such a manner that the used pad P1 is detached from the transfer unit 140 and then moves to the received pad container 170 when the transfer unit 140 moves to the pad support unit 162.

The pad guide unit 130 may be configured to separate a movement path PH1 of the used pad P1 from the movement path PH of the pad transfer unit 140. For example, the pad guide unit 130 may have an angle of slope smaller than an angle of slope of the movement path PH of the pad transfer unit 140. Here, the angle of slope of the movement path PH of the pad transfer unit 140 may be defined as an angle of slope of the movement path PH which is formed with respect to the ground when the pad transfer unit 140 moves to the pad storage 150. A height of the pad guide unit 130 may not increase as it becomes close to the received pad container 170. The height of the pad guide unit 130 may decrease as it becomes close to the received pad container 170.

The pad guide unit 130 may be arranged between the pad replacement unit 120 and the pad storage 150. The pad guide unit 130 may be arranged between the pad replacement unit 120 and the pad supply container 160. The pad guide unit 130 may be arranged between the pad replacement unit 120 and the pad support unit 162. When the pad transfer unit 140 moves from the pad replacement unit 120 toward the pad storage 150, the used pad P1 leaves from the movement path PH of the pad transfer unit 140 by the pad guide unit 130, and the pad transfer unit 140 that is empty may reach the pad supply container 160.

A pad transfer roller 131 configured to transfer the used pad P1 and the new pad P2 may be provided at the pad guide unit 130. The pad transfer roller 131 may move the used pad P1 to the received pad container 170, and may move the new pad P2 to the pad replacement unit 120. After the pad transfer roller 131 moves the used pad P1 to the received pad container 170, the pad transfer roller 131 may move the new pad P2 to the pad replacement unit 120.

The pad transfer roller 131 may contact a bottom surface of the used pad P1, and thus, may provide power that drives the used pad P1 to move to the received pad container 170. The pad transfer roller 131 may contact a bottom surface of the new pad P2, and thus, may provide power that drives the new pad P2 to move to the pad replacement unit 120. A linear velocity of the pad transfer roller 131 may be determined, in consideration of a movement velocity of the pad transfer unit 140. For example, the linear velocity of the pad transfer roller 131 may be equal to or greater than the movement velocity of the pad transfer unit 140. The linear velocity of the pad transfer roller 131 may correspond to a speed of the used pad P1 or the new pad P2 which is transferred by the pad transfer roller 131.

The pad transfer roller 131 may be provided to be contactable to a bottom surface of the used pad P1 or the new pad P2 which passes the pad guide unit 130. For example, the pad transfer roller 131 may be arranged at an end of the pad guide unit 130 which faces the received pad container 170. However, the arrangement of the pad transfer roller 131 is not limited thereto, and thus, may vary only when the arrangement is provided to enable a contact to the bottom surface of the used pad P1 or the bottom surface of the new pad P2 which passes the pad guide unit 130.

The pad transfer roller 131 may be arranged to contact the bottom surface of the new pad P2 while the new pad P2 passing the pad guide unit 130 is pressed at the second pressure area 142. For example, when the second pressure area 142 of the pad transfer unit 140 passes over the pad transfer roller 131, a gap between the second pressure area 142 and the pad transfer roller 131 may be smaller than a thickness of the new pad P2.

The pad transfer roller 131 may rotate in bi-directions. For example, the pad transfer roller 131 may rotate in a counterclockwise direction so as to move the used pad P1, and may rotate in a clockwise direction so as to move the new pad P2.

The pad transfer roller 131 may switch its rotation direction by interoperating with a movement direction of the pad transfer unit 140. For example, when the movement direction of the pad transfer unit 140 is switched, a rotation direction of the pad transfer roller 131 may be switched. For example, when the pad transfer unit 140 moves from the pad replacement unit 120 toward the pad supply container 160, the pad transfer roller 131 may move in a counterclockwise direction, and the pad transfer unit 140 moves from the pad supply container 160 toward the pad replacement unit 120, the pad transfer roller 131 may move in a clockwise direction.

As an example therefor, the pad transfer roller 131 may be configured to rotate by interoperating with a rotation of the pinion gear 184, as shown in FIG. 7. For example, the pad transfer unit 140 may further include a connection gear 185 to connect the pad transfer roller 131 to the pinion gear 184. When the pinion gear 184 rotates in a counterclockwise direction, a pad pressing member may move in the first direction D1, and the pad transfer roller 131 may rotate in a counterclockwise direction. When the pinion gear 184 rotates in a clockwise direction, the pad pressing member may move in the second direction D2, and the pad transfer roller 131 may rotate in a clockwise direction.

However, a configuration of the pad transfer roller 131 which is for a rotation is not limited thereto, and thus, may be variously modified for bi-directional rotations.

According to an embodiment of the disclosure, the station 100 may further include a fall guide 171 that induces the new pad P2 to fall to the received pad container 170. The fall guide 171 may be arranged below the movement path PH of the pad transfer unit 140. The fall guide 171 may induce the end part of the used pad P1 to face the received pad container 170. By doing so, even when the used pad P1 is not detached from the pad transfer unit 140 by the pad guide unit 130, the used pad P1 may be detached from the pad transfer unit 140 by the fall guide 171, such that it is possible to prevent the used pad P1 from entering the pad supply container 160.

Hereinafter, an operation procedure in which the used pad P1 loaded on the pad replacement unit 120 is retrieved, and the new pad P2 is supplied to the pad replacement unit 120 in the station 100 having the aforementioned configuration will now be described.

Figure 13A:
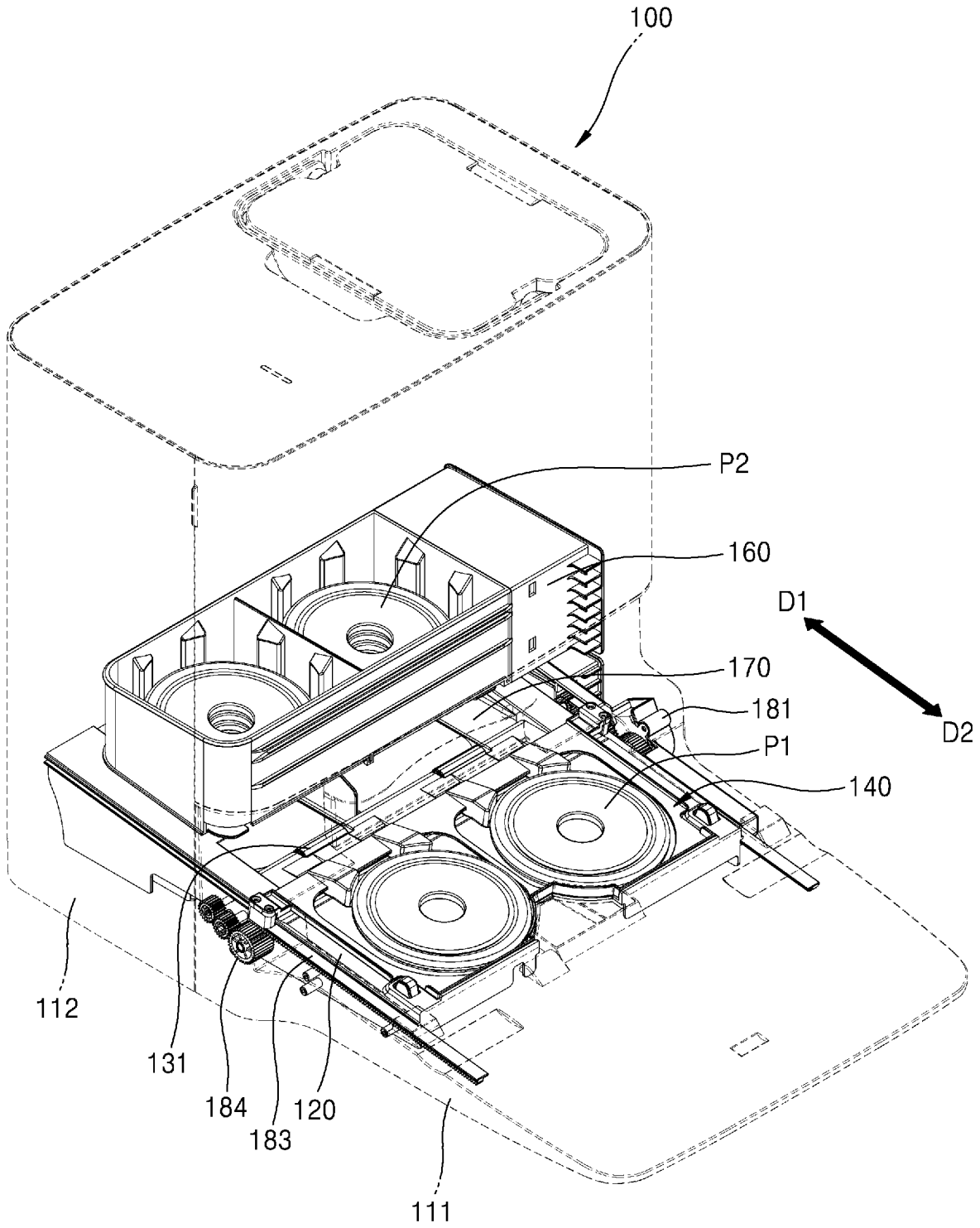
FIGS. 13A to 13C are perspective views for describing a procedure in which a used pad is retrieved in the station according to an embodiment of the disclosure.
Figure 13B:
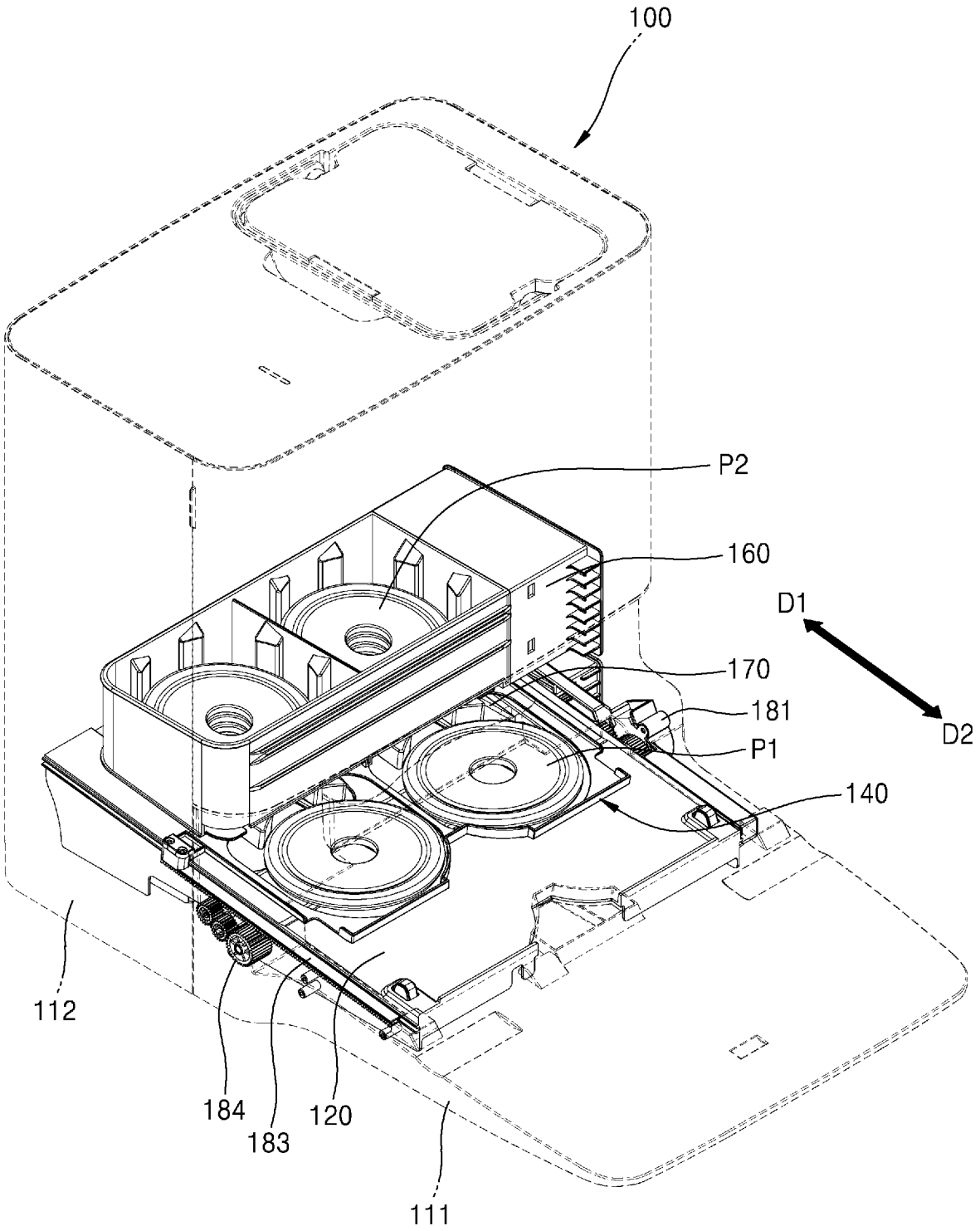
Figure 13C:
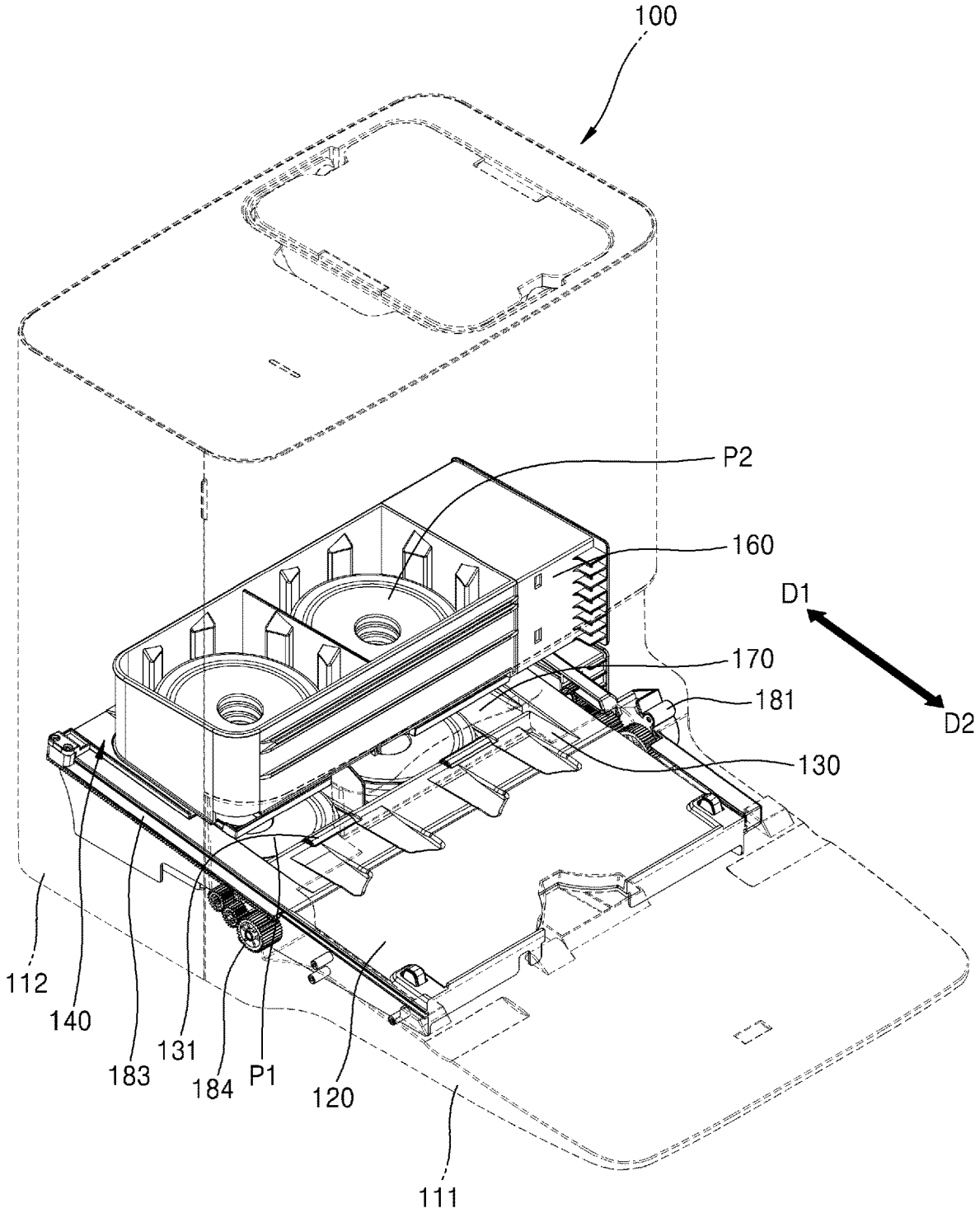
Figure 14A:
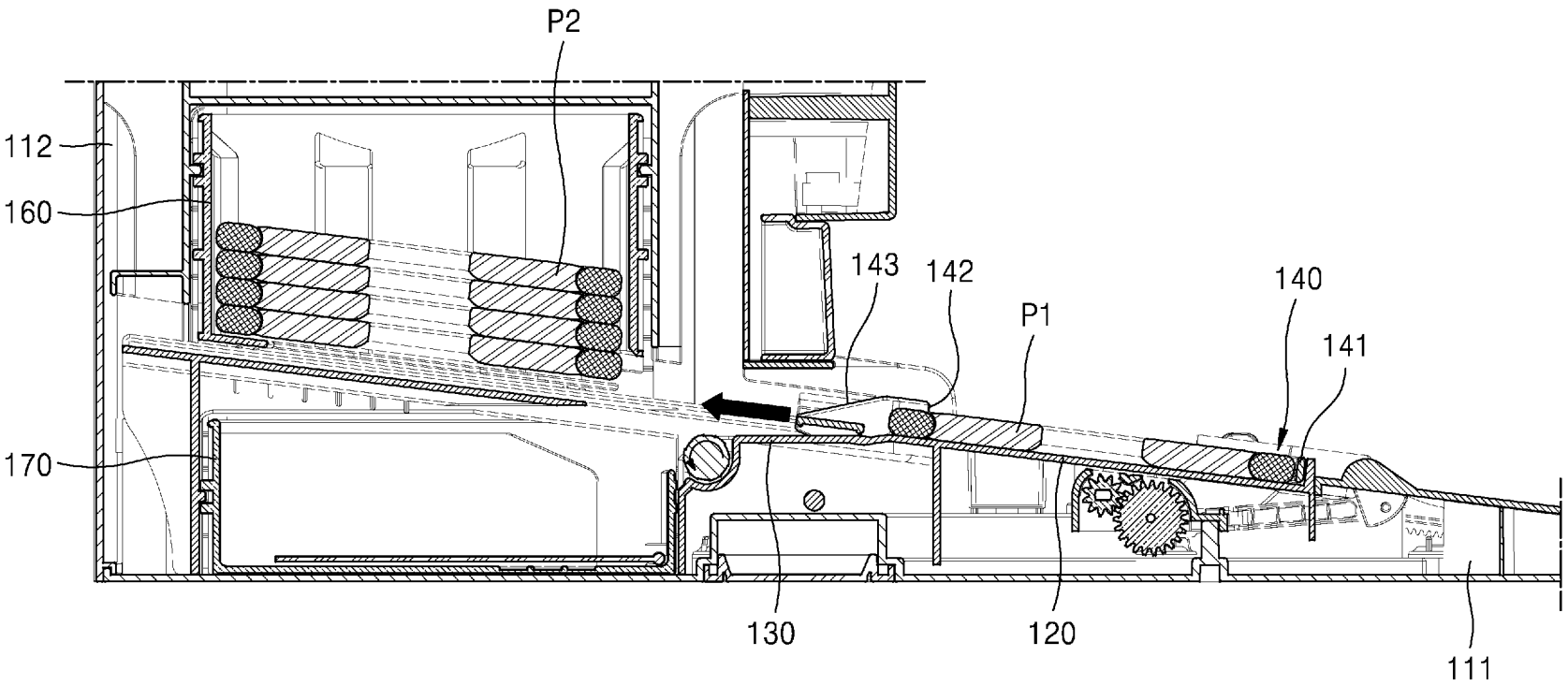
FIGS. 14A to 14C are cross-sectional views of a part of the station of FIGS. 13A to 13C.
Figure 14B:
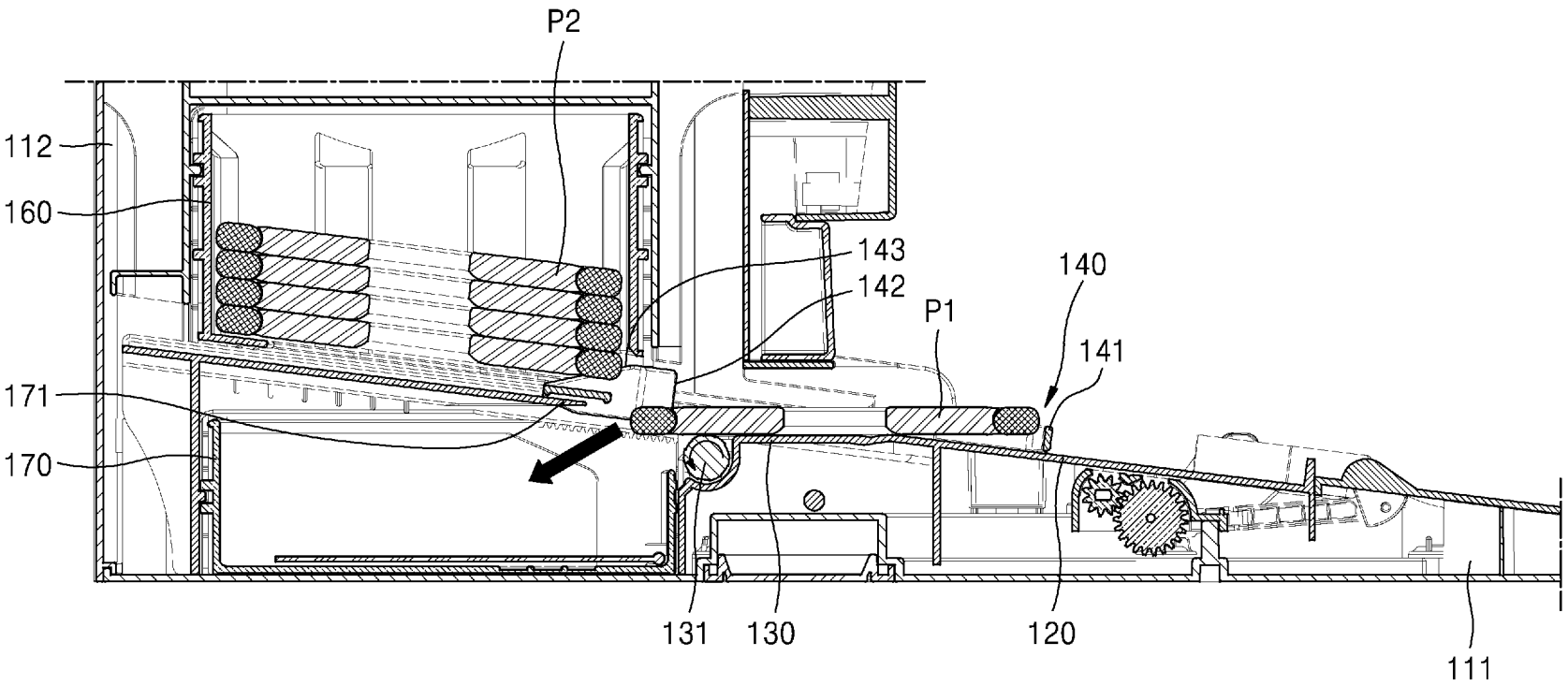
Figure 14C:
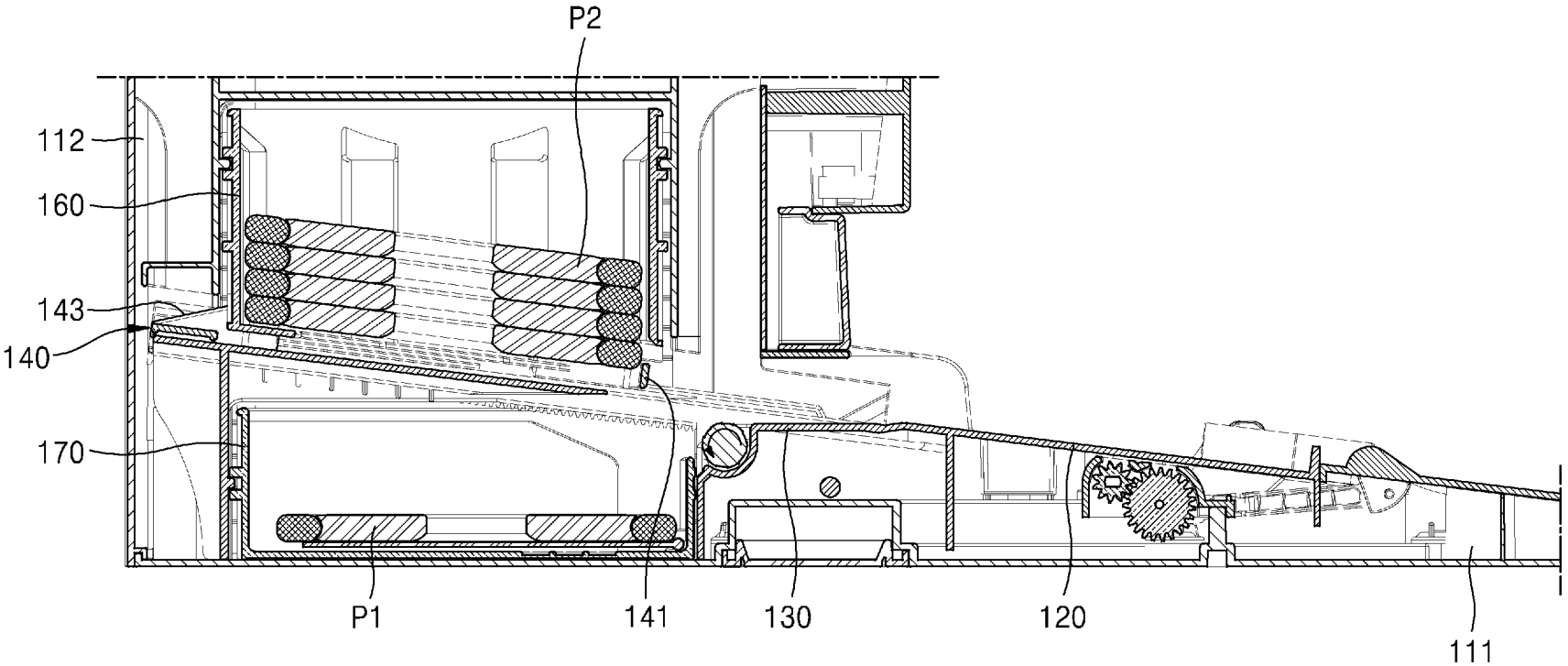
Figure 15:
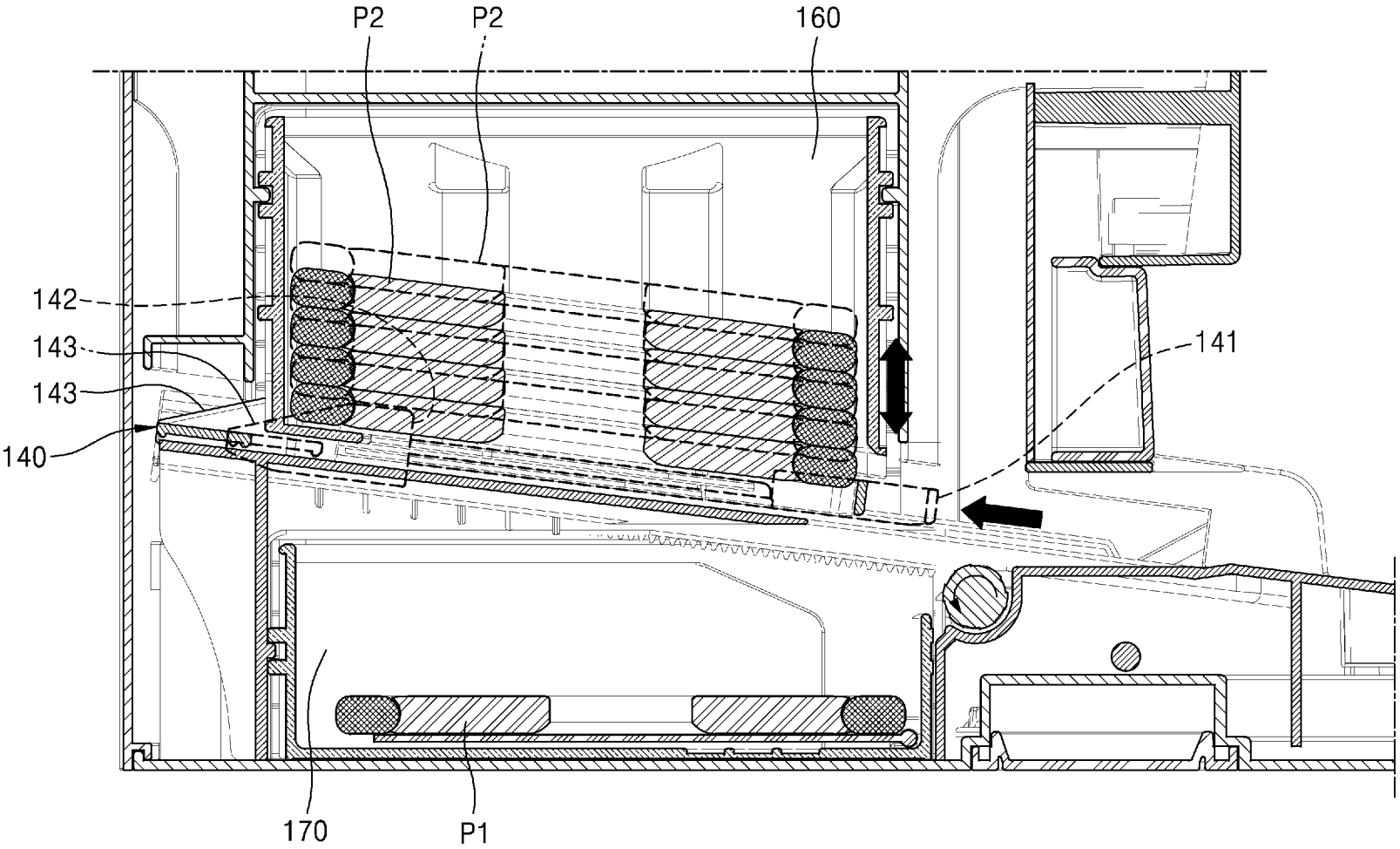
FIG. 15 is a diagram for describing a procedure in which a pad transfer unit moves in a pad supply container, in the station according to an embodiment of the disclosure.

FIGS. 13A to 13C are perspective views for describing a procedure in which the used pad P1 is retrieved in the station 100 according to an embodiment of the disclosure, and FIGS. 14A to 14C are cross-sectional views of a part of the station 100 of FIGS. 13A to 13C. FIG. 15 is a diagram for describing a procedure in which the pad transfer unit 140 moves in the pad supply container 160, in the station 100 according to an embodiment of the disclosure.

Referring to FIGS. 13A and 14A, the pad transfer unit 140 is provided on the pad replacement unit 120, the station 100 according to an embodiment of the disclosure. The used pad P1 loaded on the pad replacement unit 120 is located between the first pressure area 141 and the second pressure area 142 of the pad transfer unit 140.

In this state, the driving motor 181 operates. As the driving motor 181 operates, the pinion gear 184 connected to the driving motor 181 rotates, and the rack gear 183 engaging with the pinion gear 184 and the pad transfer unit 140 fixed to the rack gear 183 move. The pad transfer unit 140 moves toward the pad supply container 160 along the first direction D1. Here, the pad transfer roller 131 that interoperates with the pinion gear 184 rotates in a counterclockwise direction.

While the pad transfer unit 140 moves in the first direction D1, the first pressure area 141 of the pad transfer unit 140 presses the used pad P1 in the first direction D1. The used pad P1 pressed by the first pressure area 141 starts moving in the first direction D1. In the initial stage of a procedure in which the pad transfer unit 140 moves in the first direction D1, a movement direction of the used pad P1 matches a movement direction of the pad transfer unit 140.

Referring to FIGS. 13B and 14B, while the pad transfer unit 140 moves in the first direction D1, the pad transfer unit 140 passes the pad replacement unit 120 and enters the pad guide unit 130. An angle of slope of the pad guide unit 130 may be smaller than an angle of slope of the pad replacement unit 120. Accordingly, while the used pad P1 passes the pad guide unit 130, at least a front part of the used pad P1 may leave from the movement path PH of the pad transfer unit 140 in the first direction D1.

A bottom surface of the used pad P1 that passes over the pad guide unit 130 may contact the pad transfer roller 131 that rotates in a counterclockwise direction. Accordingly, the used pad P1 may be moved to the received pad container 170 by the pad transfer roller 131.

The fall guide 171 may induce falling of the used pad P1, thereby preventing the used pad P1 from entering the pad supply container 160. Even when the used pad P1 is not detached from the pad transfer unit 140 by the pad guide unit 130 and is pressed by the pad transfer unit 140, the front part of the used pad P1 is slant toward the bottom due to the gravity, and therefore, the used pad P1 may fall to enter the received pad container 170 by the fall guide 171.

Referring to FIGS. 13A and 14C, while the pad transfer unit 140 moves in the first direction D1, the pad transfer unit 140 enters the pad supply container 160 via the pad guide unit 130. In this procedure, a slope area of the uplift-downlift induce area 143 of the pad transfer unit 140 passes while contacting a bottom surface of the new pad P2 at the bottom from among the plurality of stacked new pads P2.

Referring to FIG. 15, while the pad transfer unit 140 moves in the pad supply container 160, when the uplift-downlift induce area 143 is located below the new pad P2, the new pad P2 is temporarily lifted upward as much as a height of the uplift-downlift induce area 143. Afterward, in a case where the uplift-downlift induce area 143 passes below the new pad P2, the new pad P2 is returned to its original location. That is, the new pad P2 is lifted down to its original height.

As the pad transfer unit 140 moves in the pad supply container 160, the new pad P2 is located between the first pressure area 141 and the second pressure area 142 of the pad transfer unit 140. Here, the used pad P1 leaves from the pad transfer unit 140 and then is arranged in the received pad container 170.

Figure 16A:
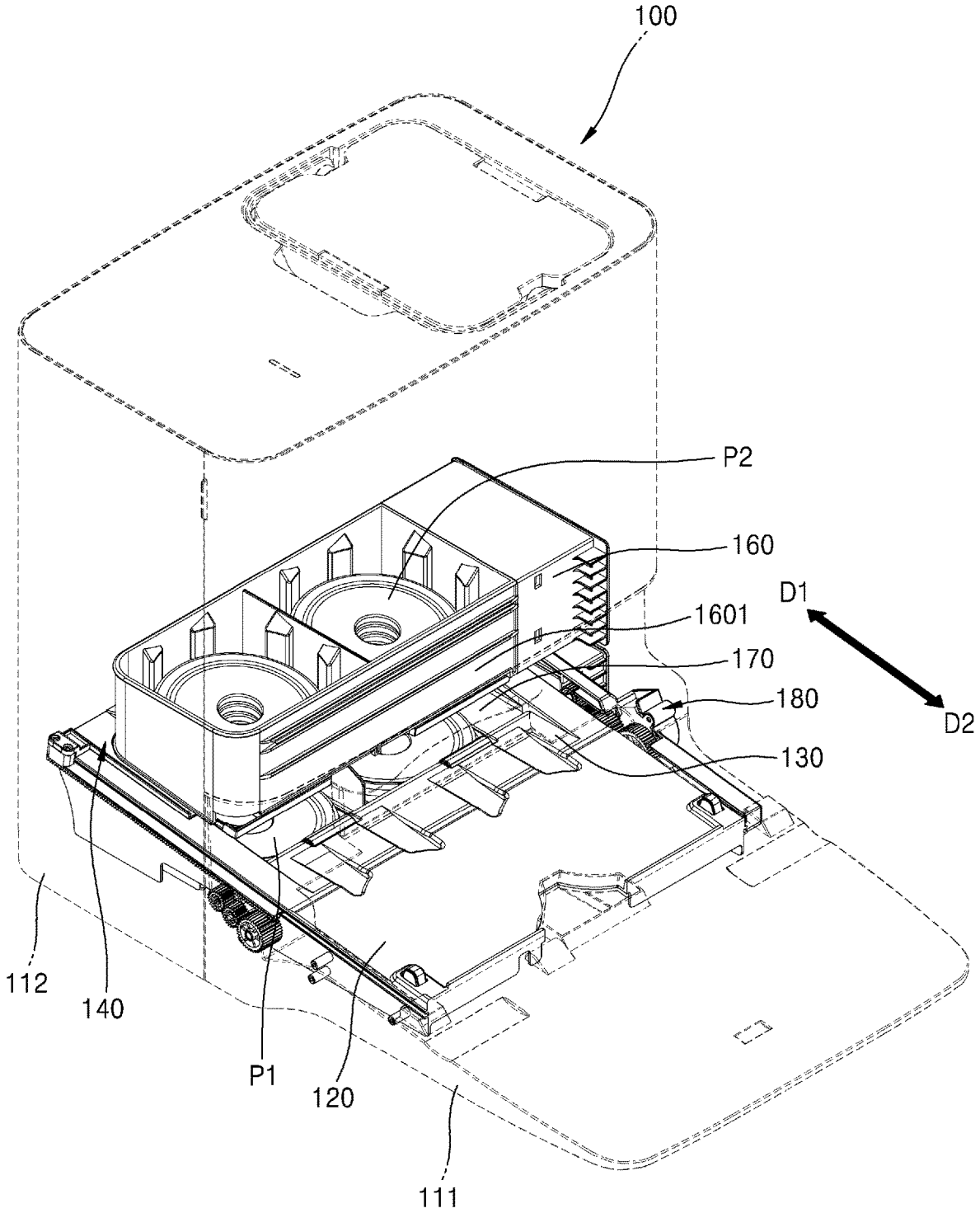
FIGS. 16A to 16C are perspective views for describing a procedure in which a new pad is supplied in the station according to an embodiment of the disclosure.
Figure 16B:
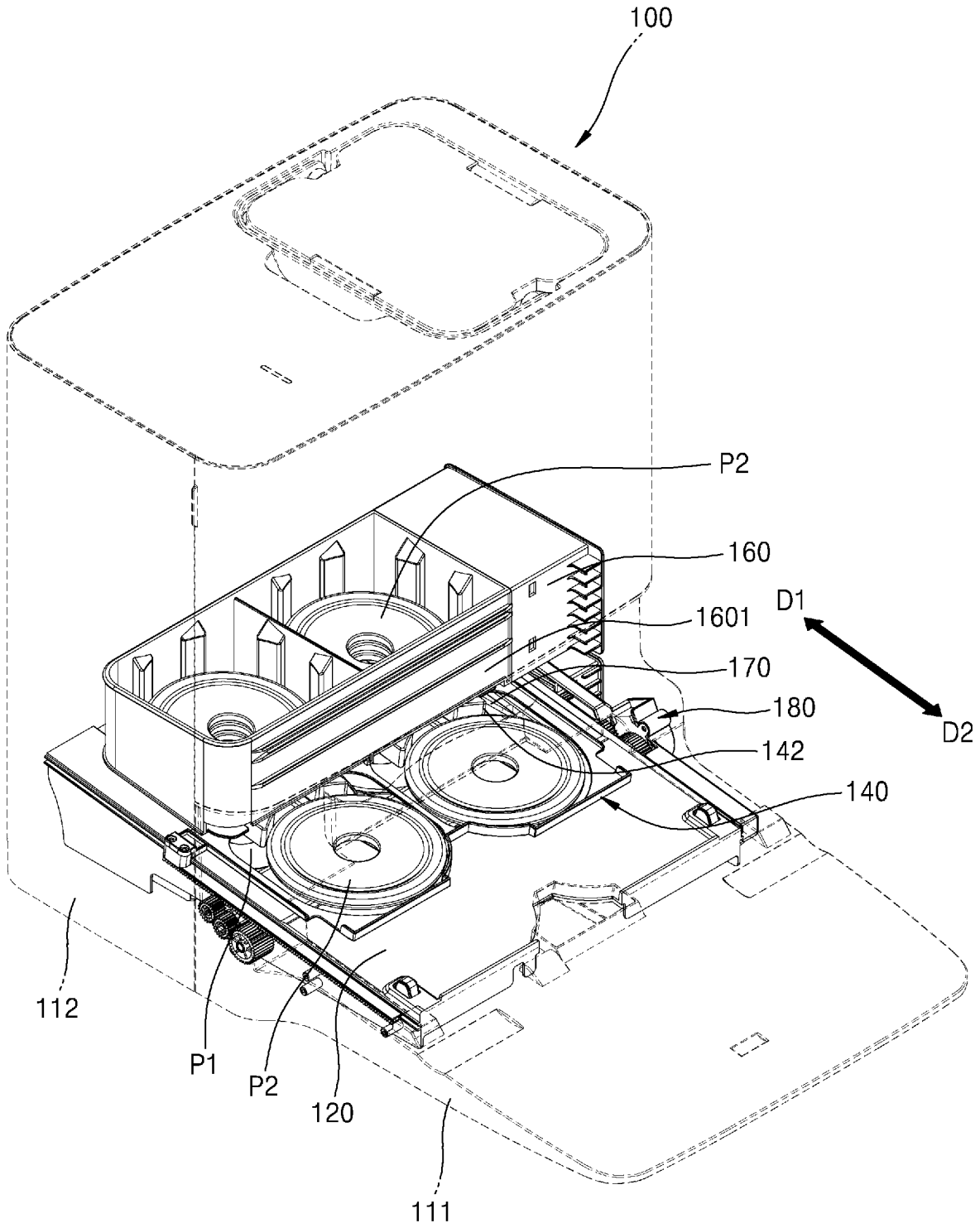
Figure 16C:
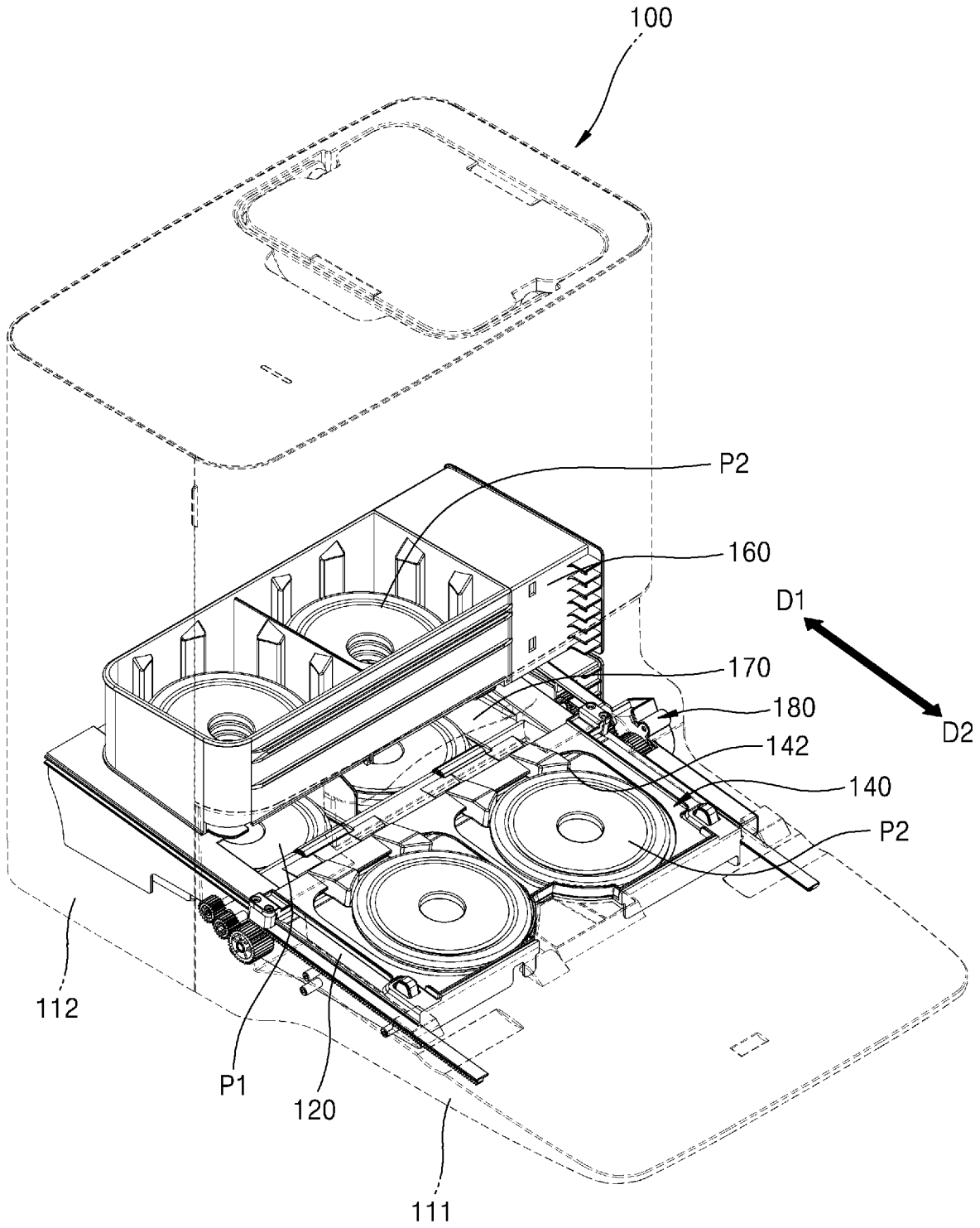
Figure 17A:
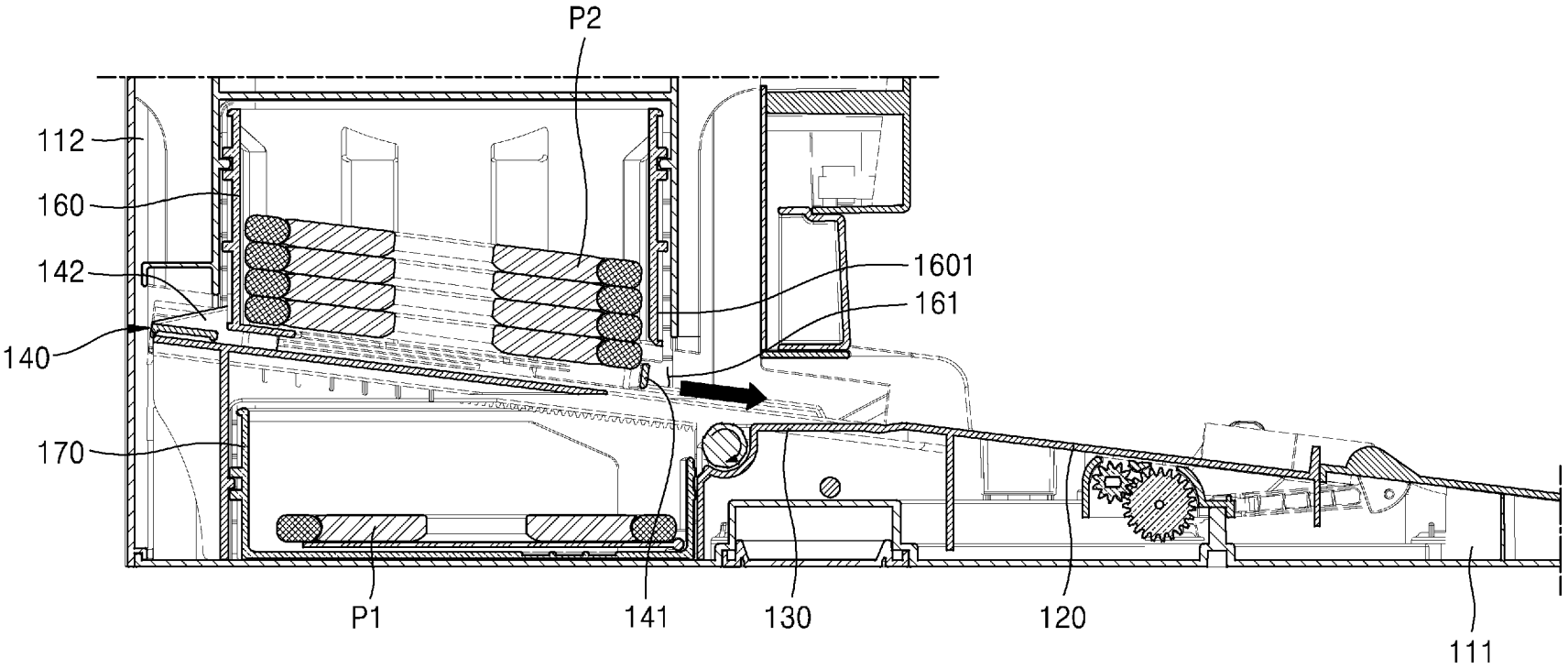
FIGS. 17A to 17C are cross-sectional views of a part of the station of FIGS. 16A to 16C.
Figure 17B:
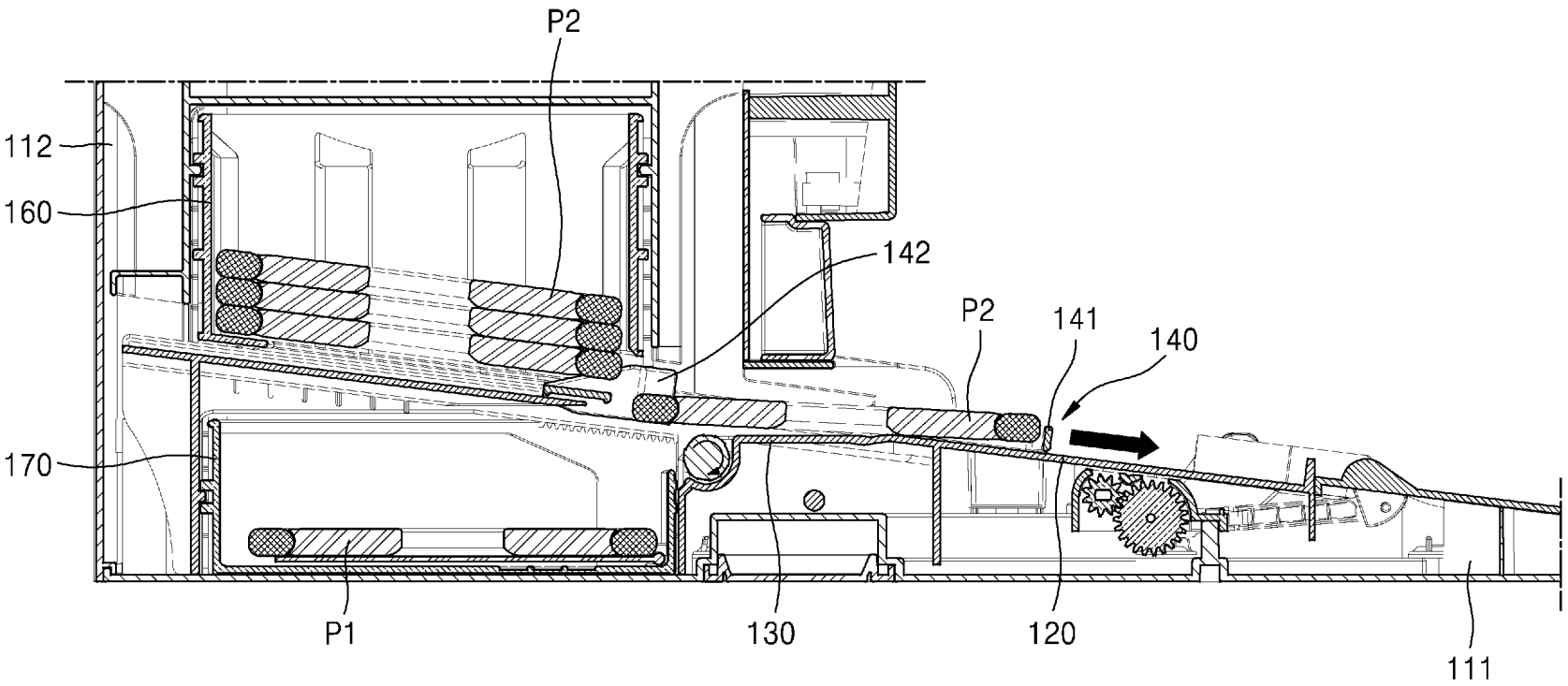
Figure 17C:
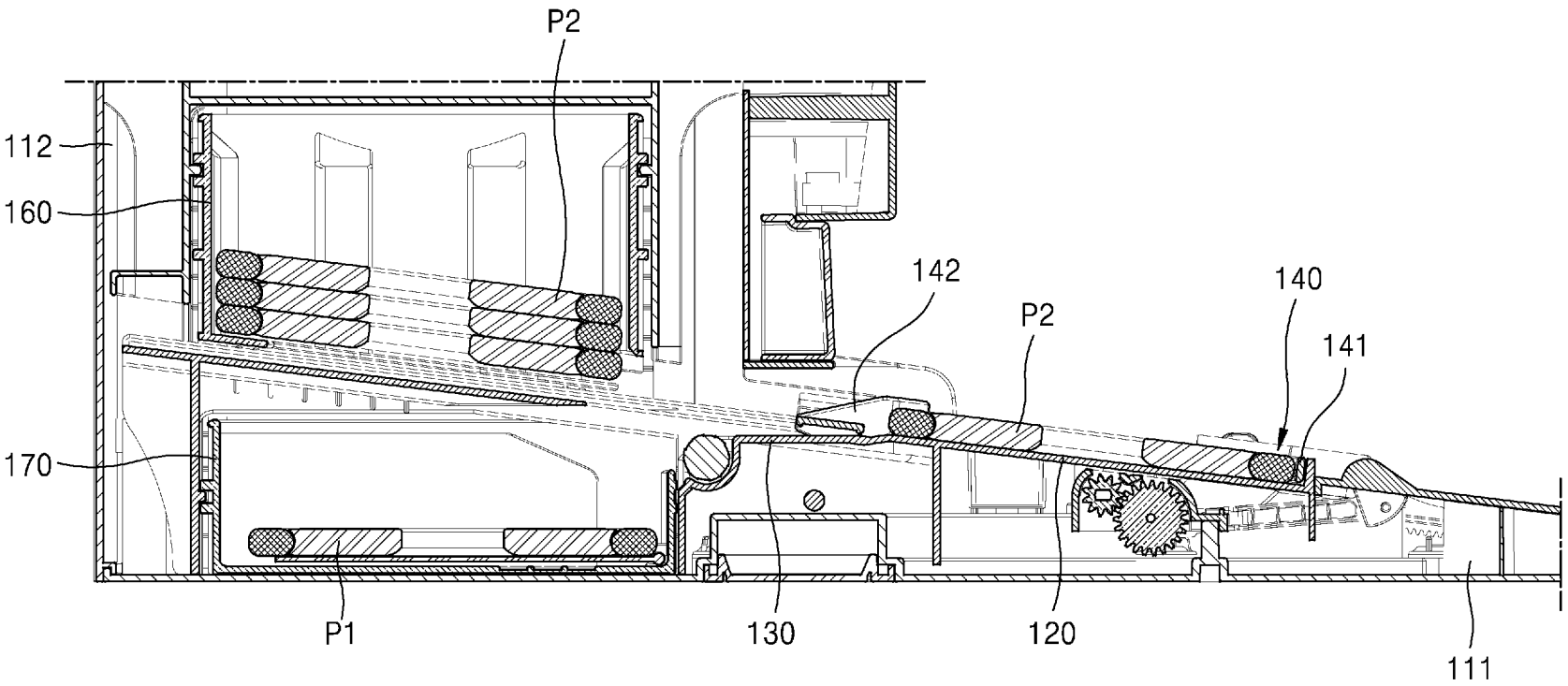
Figure 18:
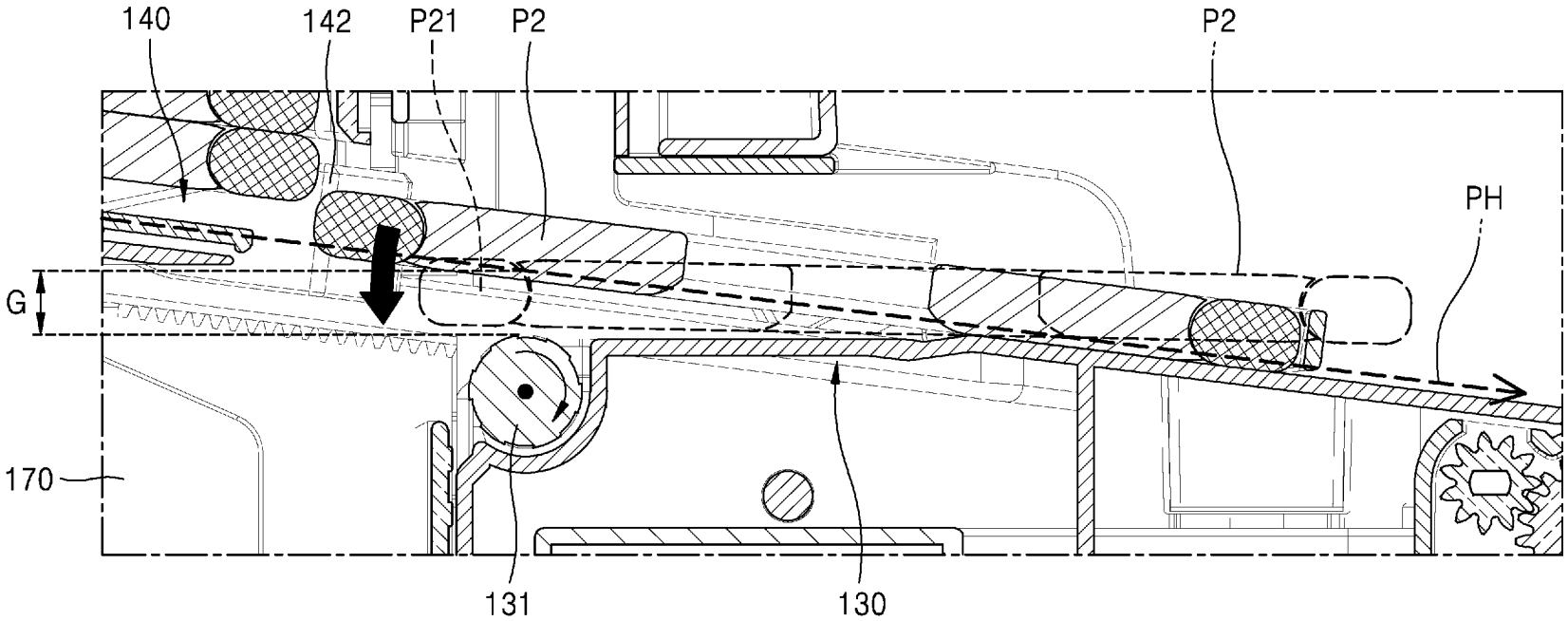
FIG. 18 is a magnified view of a part of the station of FIG. 17B.

FIGS. 16A to 16C are perspective views for describing a procedure in which the new pad P2 is supplied in the station 100 according to an embodiment of the disclosure, and FIGS. 17A to 17C are cross-sectional views of a part of the station 100 of FIGS. 16A to 16C. FIG. 18 is a magnified view of a part of the station 100 of FIG. 17B.

Referring to FIGS. 16A and 17A, the pad transfer unit 140 may be located at the pad supply container 160 so as to move the new pad P2. It is a state in which the new pad P2 is located between the first pressure area 141 and the second pressure area 142 of the pad transfer unit 140.

The pad transfer unit 140 may move in the second direction D2 so as to move the new pad P2 toward the pad replacement unit 120. To do so, the driving motor 181 of the driving unit 180 may operate in an opposite manner to an operation of the driving motor 181 to move the used pad P1.

While the pad transfer unit 140 moves in the second direction D2, the second pressure area 142 of the pad transfer unit 140 presses the new pad P2 in the second direction D2. The used pad P1 pressed by the second pressure area 142 starts moving along the second direction D2 toward the pad replacement unit 120. Only the new pad P2 at the bottom from among the plurality of new pads P2 is moved via the pad outlet 161, and movement of new pads P2 other than the new pad P2 at the bottom is restricted due to a wall 1601 that defines the pad outlet 161.

Referring to FIGS. 16B and 17B, while the pad transfer unit 140 moves in the second direction D2, the pad transfer unit 140 enters the pad guide unit 130 via the pad supply container 160. Referring to FIG. 18, while a rear end P21 of the new pad P2 passes the pad supply container 160 in the second direction D2 and then enters the pad guide unit 130, the new pad P2 may temporarily fall toward the pad transfer roller 131 due to the gravity.

A vertical gap G between the pad transfer roller 131 and the pad transfer unit 140 may be smaller than a thickness of the new pad P2. Accordingly, even when the rear end P21 of the new pad P2 temporarily falls, as the vertical gap G between the pad transfer roller 131 and the second pressure area 142 of the pad transfer unit 140 is smaller than the thickness of the new pad P2, the rear end P21 of the new pad P2 may contact the second pressure area 142 of the pad transfer unit 140. In other words, even when the rear end P21 of the new pad P2 temporarily falls while the rear end P21 of the new pad P2 passes the pad guide unit 130, the new pad P2 may be still pressed by the second pressure area 142 and may be moved in the second direction D2. Here, the vertical gap G between the pad transfer roller 131 and the pad transfer unit 140 may be defined as a gap in a vertical direction between the pad transfer roller 131 and the second pressure area 142 of the pad transfer unit 140 when the pad transfer unit 140 passes over the pad transfer roller 131.

Referring to FIGS. 16C and 17C, while the pad transfer unit 140 moves in the second direction D2, the pad transfer unit 140 passes the pad guide unit 130 and moves to the pad replacement unit 120. As the new pad P2 is pressed by the second pressure area 142 of the pad transfer unit 140, the new pad P2 is located with the pad transfer unit 140 at the pad replacement unit 120.

Hereinafter, a procedure in which the cleaning pad P of the robot cleaner 10 is replaced due to the station 100 according to the aforementioned configuration will now be described.

Figure 19:
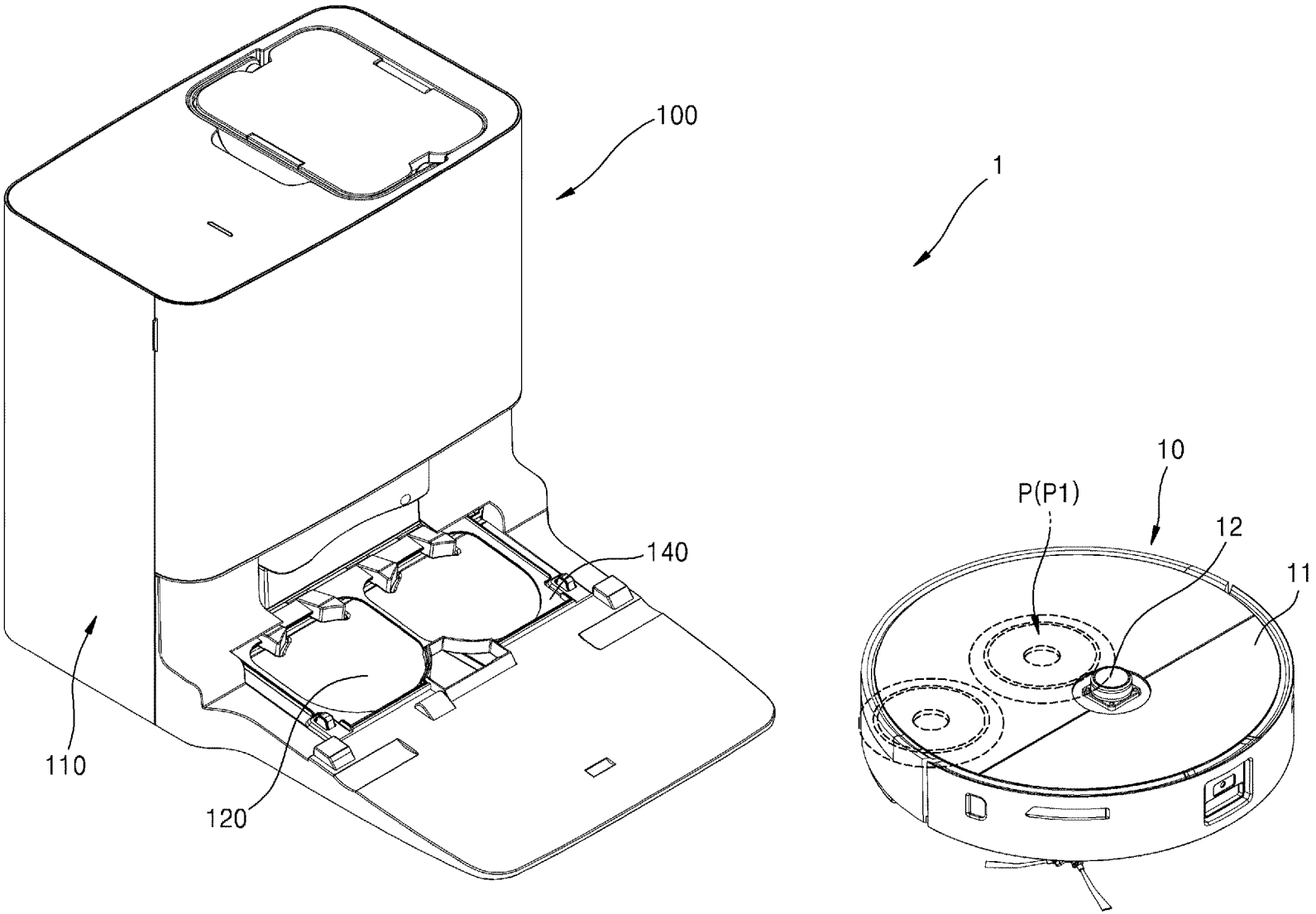
FIG. 19 is a perspective view illustrating a cleaning system according to an embodiment of the disclosure.

FIG. 19 is a perspective view illustrating the cleaning system 1 according to an embodiment of the disclosure.

Referring to FIG. 19, the robot cleaner 10 may have a state in which the cleaning pad P is attached to the body 11. The robot cleaner 10 may detect whether replacement of the cleaning pad P is required. For example, the robot cleaner 10 may detect that contamination of the cleaning pad P exceeds a preset level or may detect that cleaning has been performed over a preset period of time.

The robot cleaner 10 having detected that replacement of the cleaning pad P is required may move toward the station 100. The station 100 may be in a state in which the pad transfer unit 140 is externally exposed. For example, the pad transfer unit 140 of the station 100 may be located at the pad replacement unit 120. The pad transfer unit 140 located at the pad replacement unit 120 may have an empty state to which the cleaning pad P is not loaded. The pad transfer unit 140 of the station 100 may have an initial state that is the empty state to which the cleaning pad P is not loaded. In another expression, the pad replacement unit 120 may have a state in which the cleaning pad P is not located until the cleaning pad P is detached from the robot cleaner 10.

The robot cleaner 10 may move to the station 100. For example, the robot cleaner 10 may move to the pad transfer unit 140 of the station 100. The robot cleaner 10 may move such that the cleaning pad P can be overlapped to the pad transfer unit 140. Here, the pad transfer unit 140 may have an initial state in which the pad transfer unit 140 is located at the pad replacement unit 120 while the cleaning pad P is not loaded.

After the robot cleaner 10 moves to the station 100, the robot cleaner 10 may detach the cleaning pad P whose usage is ended, for example, the used pad P1. The detached used pad P1 is loaded on the pad replacement unit 120 as shown in FIG. 3.

The station 100 may determine whether pad replacement of the robot cleaner 10 is required. For example, in order to determine whether pad replacement is required, the station 100 may receive a signal related to pad replacement from the robot cleaner 10 or may detect a location of the robot cleaner 10 or a location of the cleaning pad P. For example, the station 100 may receive a signal related to pad replacement from the robot cleaner 10, thereby determining whether pad replacement is required. For example, even when the station 100 does not receive a signal from the robot cleaner 10, the robot cleaner 10 may detect whether the robot cleaner 10 is located on the station 100 and the cleaning pad P is located on the pad replacement unit 120, thereby determining whether pad replacement of the robot cleaner 10 is required.

When it is determined that pad replacement of the robot cleaner 10 is required, the station 100 may transfer the used pad P1 to the received pad container 170 and may transfer the new pad P2 to the pad replacement unit 120.

The used pad P1 loaded on the pad replacement unit 120 is transferred to the received pad container 170 while the pad transfer unit 140 moves to the pad storage 150 as shown in FIGS. 14A to 14C, and the new pad P2 stored in the pad supply container 160 is transferred to the pad replacement unit 120 while the pad transfer unit 140 moves from the pad storage 150 toward the pad replacement unit 120 as shown in FIGS. 17A to 17C.

The station 100 may detect the new pad P2 that is transferred to the pad replacement unit 120. The robot cleaner 10 may have the detected new pad P2 attached thereto.

As above, while the pad transfer unit 140 reciprocates, the station 100 according to an embodiment of the disclosure may retrieve the used pad P1 by moving the used pad P1 loaded on the pad replacement unit 120 to the received pad container 170, and may supply the new pad P2 to the robot cleaner 10 by moving the new pad P2 stored in the pad supply container 160 to the pad replacement unit 120. In this manner, as the used pad P1 and the new pad P2 are transferrable according to reciprocating movement of the pad transfer unit 140, a structure of the station 100 may be simplified, and a size of the station 100 may be minimized.

The station 100 according to an embodiment of the disclosure is described with respect to a pad replacement function of retrieving the used pad P1 from the robot cleaner 10 and supplying the new pad P2. However, the station 100 according to an embodiment of the disclosure is not limited to the pad replacement function, and may provide a pad supply function of supplying the new pad P2 to the robot cleaner 10 to which the cleaning pad P is not attached.

Figure 20:
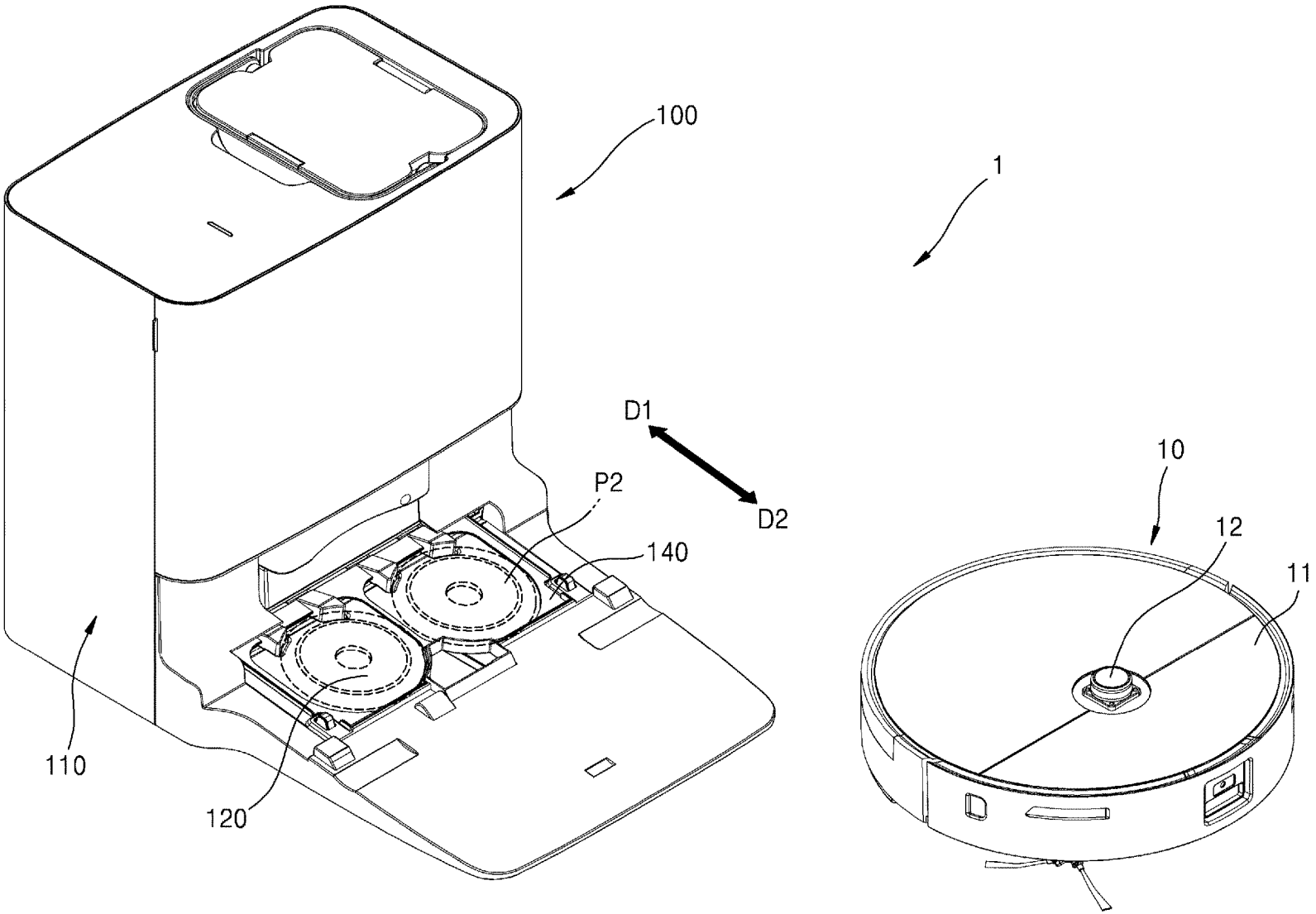
FIG. 20 is a perspective view for describing an example in which the station performs a pad supply function in a cleaning system according to an embodiment of the disclosure.

FIG. 20 is a perspective view for describing an example in which the station 100 performs the pad supply function in the cleaning system 1 according to an embodiment of the disclosure.

Referring to FIG. 20, the robot cleaner 10 in the cleaning system 1 according to an embodiment of the disclosure may detect whether the cleaning pad P is attached to the body 11. When it is detected that the cleaning pad P is not attached to the body 11, the robot cleaner 10 may move to the station 100. Here, the pad transfer unit 140 at the pad replacement unit 120 may have an empty state in which the cleaning pad P is not loaded and thus may be at an initial position.

The station 100 may determine whether it is required to supply a pad to the robot cleaner 10. For example, the station 100 may receive a signal related to supplying of a pad from the robot cleaner 10 or may detect at least one of a location of the robot cleaner 10 or a location of the cleaning pad P, thereby determining whether it is required to supply a pad to the robot cleaner 10.

When it is determined that it is required to supply a pad to the robot cleaner 10, the station 100 may transfer the new pad P2 to the pad replacement unit 120.

For example, when the cleaning pad P is not attached to the robot cleaner 10, the station 100 may allow the pad transfer unit 140 to reciprocate. The pad transfer unit 140 may move from the pad replacement unit 120 to the pad storage 150 along the first direction D1 and then may move from the pad storage 150 to the pad replacement unit 120 in the second direction D2.

When the pad transfer unit 140 moves from the pad replacement unit 120 to the pad storage 150, the pad transfer unit 140 does not have the used pad P1. In a procedure in which the pad transfer unit 140 returns from the pad storage 150 to the pad replacement unit 120, the pad transfer unit 140 may move while pressing the new pad P2.

In a procedure of reciprocating movement of the pad transfer unit 140, the new pad P2 may be arranged on the pad replacement unit 120 of the station 100. The reciprocating movement of the pad transfer unit 140 for transferring the new pad P2 may be performed before the robot cleaner 10 reaches the station 100, but the disclosure is not limited thereto. For example, movement of the pad transfer unit 140 for transferring the new pad P2 may be performed after the robot cleaner 10 reached the station 100.

The robot cleaner 10 may have the new pad P2 attached thereto, the new pad P2 being transferred to the pad replacement unit 120. In this manner, the station 100 may perform the pad supply function of supplying the new pad P2 to the robot cleaner 10 as the pad transfer unit 140 transfers the new pad P2 to the pad replacement unit 120.

In the aforementioned embodiment of the disclosure, an example in which the station 100 and the cleaning system 1 including the same replace or supply the cleaning pad P of the robot cleaner 10 is described. However, a purpose or an application target of the station 100 and the cleaning system 1 including the same according to an embodiment of the disclosure is not limited thereto, and thus, may vary. For example, the station 100 according to an embodiment of the disclosure may be applied to replace a cleaning pad P of a cleaner other than the robot cleaner 10, e.g., a cordless cleaner.

For understanding of the disclosure, reference numerals are written in embodiments shown in the drawings and specific terms are used to describe the embodiments of the disclosure, but the disclosure is not limited by the specific terms and the disclosure may include all elements commonly conceivable by one of ordinary skill in the art.

The particular implementations shown and described in the disclosure are embodiments of the disclosure and are not intended to otherwise limit the scope of the disclosure in any way. For the sake of brevity of the present specification, electronics according to the related art, control systems, software and other functional aspects of the systems may not be described in detail. Furthermore, the connecting lines or connectors between elements shown in the drawings are intended to represent exemplary functional relationships and/or physical or logical couplings between the elements, and it should be noted that many alternative or additional functional relationships, physical connections or logical connections may be present in a practical device. Also, no element is essential to the practice of the disclosure unless the element is specifically described as "essential" or "critical". Expressions such as "comprising" and "including" used herein are to be understood as terms of an open end technology.

The use of the terms "a" and "an" and "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range (unless otherwise indicated herein), and each separate value is incorporated into the specification as if it were individually recited herein. Finally, the steps of all methods described in the disclosure can be performed in any suitable order unless otherwise indicated herein or otherwise clearly contradicted by context. The disclosure is not limited by the steps described herein. The use of any and all examples, or exemplary language (e.g., "such as") provided herein, is intended merely to better illuminate the disclosure and does not pose a limitation on the scope of the disclosure unless otherwise claimed. Also, numerous modifications and adaptations will be readily apparent to one of ordinary skill in the art, without departing from the spirit and scope of the disclosure.

According to an embodiment of the disclosure, a station and a cleaning system may retrieve a used cleaning pad from a robot cleaner, and may supply a new cleaning pad, without a user's help.

According to an embodiment of the disclosure, the station and the cleaning system may replace a cleaning pad of a robot cleaner and may have a compact size.

According to an embodiment of the disclosure, a station for use with a robot cleaner, the station may include a pad replacement unit; a pad storage including a received pad container and a pad supply container; and a pad transfer unit. The pad replacement unit, the pad storage, and the pad transfer unit may be configured so that the pad transfer unit is movable in a first direction along a movement path from the pad replacement unit to the pad storage while pressing a used pad that was detached from the robot cleaner and loaded in the pad replacement unit, so that the used pad is moved by the pad transfer unit to the pad storage and received in the received pad container, and the pad transfer unit is movable in a second direction, opposite the first direction, along the movement path from the pad storage to the pad replacement unit while pressing a new pad that was stored in the pad supply container and supplied to the pad transfer unit, so that the new pad is moved by the pad transfer unit to the pad replacement unit to be attached to the robot cleaner. The pad supply container is above the movement path, and the received pad container is below the movement path.

The station may include a station body including a station base in which the pad replacement unit is arranged, and a station tower in which the pad storage is arranged, and the pad supply container and the received pad container are vertically aligned in the station tower.

The pad transfer unit may include a first pressure area configured to, when the pad transfer unit moves in the first direction along the movement path from the pad replacement unit to the pad storage while pressing the used pad, press the used pad to orientate the used pad to face the received pad container, and a second pressure area configured to, when the pad transfer unit moves in the second direction along the movement path from the pad storage to the pad replacement unit while pressing the new pad, press the new pad to orientate the new pad to face the pad replacement unit.

The station may further include a pad guide unit between the pad storage and the pad replacement unit, and configured to, when the pad transfer unit moves in the first direction along the movement path from the pad replacement unit to the pad storage while pressing the used pad, allow the used pad to detach from the pad transfer unit and then move to the received pad container.

The pad guide unit may have an angle of slope smaller than an angle of slope of the movement path.

The station may further include a pad transfer roller configured to, when the pad transfer unit moves in the first direction while pressing the used pad, and the used pad has not yet been received in the received pad container, contact the used pad and rotate so that the used pad moves to the received pad container, and when the pad transfer unit moves in the second direction, and the new pad has not yet been supplied to the pad replacement unit, contact the new pad and rotate so that the new pad moves to the pad replacement unit.

A rotation direction of the pad transfer roller when the pad transfer unit moves in the first direction may be opposite to a rotation direction of the pad transfer roller when the pad transfer unit moves in the second direction.

A vertical gap between the pad transfer roller and the pad transfer unit may be smaller than a thickness of the new pad.

A height of the second pressure area may be greater than a thickness of the new pad.

The pad transfer unit may include an uplift-downlift induce area having a slope that, when the pad transfer unit moves in the first direction, induces uplift and downlift of the new pad so that the new pad is supplied to the pad transfer unit.

According to an embodiment of the disclosure, a cleaning system may include a robot cleaner; and a station including a pad replacement unit, a pad storage including a received pad container and a pad supply container, and a pad transfer unit, wherein the pad replacement unit, the pad storage, and the pad transfer unit are configured so that the pad transfer unit is movable in a first direction along a movement path from the pad replacement unit to the pad storage while pressing a used pad that was detached from the robot cleaner and loaded in the pad replacement unit, so that the used pad is moved by the pad transfer unit to the pad storage and received in the received pad container, and the pad transfer unit is movable in a second direction, opposite the first direction, along the movement path from the pad storage to the pad replacement unit while pressing a new pad that was stored in the pad supply container and supplied to the pad transfer unit, so that the new pad is moved by the pad transfer unit to the pad replacement unit to be attached to the robot cleaner, and the pad supply container is above the movement path, and the received pad container is below the movement path.

The station may include a station body including a station base in which the pad replacement unit is arranged, and a station tower in which the pad storage is arranged, and the pad supply container and the received pad container are vertically aligned in the station tower.

The pad transfer unit may include a first pressure area configured to, when the pad transfer unit moves in the first direction along the movement path from the pad replacement unit to the pad storage while pressing the used pad, press the used pad to orientate the used pad to face the received pad container, and a second pressure area configured to, when the pad transfer unit moves in the second direction along the movement path from the pad storage to the pad replacement unit while pressing the new pad, press the new pad to orientate the new pad to face the pad replacement unit.

The station may include a pad guide unit between the pad storage and the pad replacement unit, and configured to, when the pad transfer unit moves in the first direction along the movement path from the pad replacement unit to the pad storage while pressing the used pad, allow the used pad to detach from the pad transfer unit and then move to the received pad container.

The pad transfer unit may include an uplift-downlift induce area having a slope that, when the pad transfer unit moves in the first direction, induces uplift and downlift of the new pad so that the new pad is supplied to the pad transfer unit.

According to an embodiment of the disclosure, provided are a station and a cleaning system which may retrieve a used cleaning pad from a robot cleaner and may supply a new cleaning pad, without a user's help.

According to an embodiment of the disclosure, provided are a station and a cleaning system which may replace a cleaning pad of a robot cleaner and may have a compact size.

The invention claimed is:

1. A station for use with a robot cleaner, the station comprising:

a pad replacement unit;

a pad storage including a received pad container and a pad supply container; and a pad transfer unit, wherein the pad replacement unit, the pad storage, and the pad transfer unit are configured such that the pad transfer unit is movable in a first direction along a movement path from the pad replacement unit to the pad storage while pressing a used pad that was detached from the robot cleaner and loaded in the pad replacement unit, such that the used pad is moved by the pad transfer unit to the pad storage and received in the received pad container, wherein at least a portion of the movement path is parallel to a slant surface on which the robot cleaner travels to enter and exit the station, and the pad transfer unit is movable in a second direction, opposite the first direction, along the movement path from the pad storage to the pad replacement unit while pressing a new pad that was stored in the pad supply container and supplied to the pad transfer unit, such that the new pad is moved by the pad transfer unit to the pad replacement unit to be attached to the robot cleaner, and the pad supply container is at a fixed position above the movement path, and the received pad container is at a fixed position below the movement path.

2. The station of claim 1, further comprising:

a station body including a station base in which the pad replacement unit is arranged, and a station tower in which the pad storage is arranged, wherein the station base forms the slant surface, and the pad supply container and the received pad container are vertically aligned in the station tower.

3. The station of claim 1, wherein the pad transfer unit includes:

a first pressure area configured to, when the pad transfer unit moves in the first direction along the movement path from the pad replacement unit to the pad storage while pressing the used pad, press the used pad to orientate the used pad to face the received pad container, and a second pressure area configured to, when the pad transfer unit moves in the second direction along the movement path from the pad storage to the pad replacement unit while pressing the new pad, press the new pad to orientate the new pad to face the pad replacement unit.

4. The station of claim 3, further comprising:

a pad guide unit between the pad storage and the pad replacement unit, and configured to, when the pad transfer unit moves in the first direction along the movement path from the pad replacement unit to the pad storage while pressing the used pad, allow the used pad to detach from the pad transfer unit and then move to the received pad container.

5. The station of claim 4, wherein the pad guide unit has an angle of slope smaller than an angle of slope of the movement path.

6. The station of claim 4, further comprising:

a pad transfer roller configured such that, when the pad transfer unit moves in the first direction while pressing the used pad, and the used pad has not yet been received in the received pad container, the pad transfer roller contacts the used pad and rotates such that the used pad moves to the received pad container, and when the pad transfer unit moves in the second direction, and the new pad has not yet been supplied to the pad replacement unit, the pad transfer roller contacts the new pad and rotates such that the new pad moves to the pad replacement unit.

7. The station of claim 6, wherein a rotation direction of the pad transfer roller when the pad transfer unit moves in the first direction is opposite to a rotation direction of the pad transfer roller when the pad transfer unit moves in the second direction.

8. The station of claim 6, wherein a vertical gap between the pad transfer roller and the pad transfer unit is smaller than a thickness of the new pad.

9. The station of claim 3, wherein a height of the second pressure area is greater than a thickness of the new pad.

10. The station of claim 1, wherein the pad transfer unit includes an uplift-downlift induce area having a slope that, when the pad transfer unit moves in the first direction, induces uplift and downlift of the new pad such that the new pad is supplied to the pad transfer unit.

11. A cleaning system comprising:

a robot cleaner; and a station including:

a pad replacement unit, a pad storage including a received pad container and a pad supply container, and a pad transfer unit, wherein the pad replacement unit, the pad storage, and the pad transfer unit are configured such that the pad transfer unit is movable in a first direction along a movement path from the pad replacement unit to the pad storage while pressing a used pad that was detached from the robot cleaner and loaded in the pad replacement unit, such that the used pad is moved by the pad transfer unit to the pad storage and received in the received pad container, wherein at least a portion of the movement path is parallel to a slant surface on which the robot cleaner travels to enter and exit the station, and the pad transfer unit is movable in a second direction, opposite the first direction, along the movement path from the pad storage to the pad replacement unit while pressing a new pad that was stored in the pad supply container and supplied to the pad transfer unit, such that the new pad is moved by the pad transfer unit to the pad replacement unit to be attached to the robot cleaner, and the pad supply container is at a fixed position above the movement path, and the received pad container is at a fixed position below the movement path.

12. The cleaning system of claim 11, wherein the station includes:

a station body including a station base in which the pad replacement unit is arranged, and a station tower in which the pad storage is arranged, wherein the station base forms the slant surface, and the pad supply container and the received pad container are vertically aligned in the station tower.

13. The cleaning system of claim 11, wherein the pad transfer unit includes:

a first pressure area configured to, when the pad transfer unit moves in the first direction along the movement path from the pad replacement unit to the pad storage while pressing the used pad, press the used pad to orientate the used pad to face the received pad container, and a second pressure area configured to, when the pad transfer unit moves in the second direction along the movement path from the pad storage to the pad replacement unit while pressing the new pad, press the new pad to orientate the new pad to face the pad replacement unit.

14. The cleaning system of claim 13, wherein the station includes:

a pad guide unit between the pad storage and the pad replacement unit, and configured to, when the pad transfer unit moves in the first direction along the movement path from the pad replacement unit to the pad storage while pressing the used pad, allow the used pad to detach from the pad transfer unit and then move to the received pad container.

15. The cleaning system of claim 11, wherein the pad transfer unit includes an uplift-downlift induce area having a slope that, when the pad transfer unit moves in the first direction, induces uplift and downlift of the new pad such that the new pad is supplied to the pad transfer unit.

* * * * *